US010513119B2

(12) United States Patent
Inoue et al.

(10) Patent No.: US 10,513,119 B2
(45) Date of Patent: Dec. 24, 2019

(54) INKJET RECORDING METHOD AND INKJET RECORDING APPARATUS

(71) Applicant: CANON KABUSHIKI KAISHA, Tokyo (JP)

(72) Inventors: Koji Inoue, Tokyo (JP); Noboru Toyama, Kawasaki (JP); Akihiro Mouri, Fuchu (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/021,491

(22) Filed: Jun. 28, 2018

(65) Prior Publication Data

US 2019/0009550 A1 Jan. 10, 2019

(30) Foreign Application Priority Data

Jul. 4, 2017 (JP) ..... 2017-131559

(51) Int. Cl.

| | |
|---|---|
| ***B41J 2/175*** | (2006.01) |
| ***B41J 2/165*** | (2006.01) |
| ***B41J 11/00*** | (2006.01) |
| ***B41J 2/005*** | (2006.01) |
| ***B41J 2/01*** | (2006.01) |
| ***B41J 29/17*** | (2006.01) |
| ***B41M 5/00*** | (2006.01) |

(52) U.S. Cl.

CPC ..... *B41J 2/16505* (2013.01); *B41J 2/0057* (2013.01); *B41J 2/01* (2013.01); *B41J 11/0015* (2013.01); *B41J 29/17* (2013.01); *B41M 5/0017* (2013.01); *B41J 2002/012* (2013.01)

(58) Field of Classification Search

CPC ..... B41J 2/0057

USPC ..... 347/103

See application file for complete search history.

(56) References Cited

U.S. PATENT DOCUMENTS 6,824,839 B1 * 11/2004 Popat ..... B41M 3/006 347/105

2003/0067528 A1 * 4/2003 Chowdry ..... B41J 2/04 347/103

(Continued)

FOREIGN PATENT DOCUMENTS

JP 2009-045851 A 3/2009

OTHER PUBLICATIONS

U.S. App. No. 16,021,510 Koji Inoue Noboru Toyama Akihiro Mouri Toru Ohnishi filed Jun. 28, 2018.

*Primary Examiner* — Lam S Nguyen

(74) *Attorney, Agent, or Firm* — Venable LLP

(57) ABSTRACT

An inkjet recording method includes applying an aqueous ink and a reaction liquid for increasing the viscosity of the ink to an ejection target medium to form an ink image thereon. The ink image is then subjected to a liquid absorbing treatment using a porous body having a liquid absorbing surface. In the liquid absorption treatment, the liquid absorbing surface is brought into contact with the ink image to absorb at least a part of the liquid component from the ink image by the porous body and the porous body is used repeatedly while it is sometimes carried out from the liquid absorption treatment region for cleaning. Contact information of the porous body including the number of contact times and a contact pressure in each contact is stored and the gas permeability state of the porous body is evaluated by using such contact information.

23 Claims, 11 Drawing Sheets

(56) References Cited

U.S. PATENT DOCUMENTS

| | | | | |
|---|---|---|---|---|
| 2005/0110854 | A1* | 5/2005 | Roof | B41J 2/0057 347/103 |
| 2015/0085039 | A1* | 3/2015 | Liu | C09D 11/38 347/102 |
| 2017/0217191 | A1 | 8/2017 | Hirokawa et al. | |
| 2017/0217216 | A1 | 8/2017 | Ohnishi et al. | |
| 2018/0311951 | A1 | 11/2018 | Sakamoto et al. | |
| 2018/0319179 | A1 | 11/2018 | Yamane et al. | |
| 2018/0326719 | A1 | 11/2018 | Masuda et al. | |
| 2018/0326755 | A1 | 11/2018 | Ohnishi et al. | |

* cited by examiner

INKJET RECORDING METHOD AND INKJET RECORDING APPARATUS

BACKGROUND OF THE INVENTION

Field of the Invention

The present invention relates to an inkjet recording method and an inkjet recording apparatus using a liquid absorbing treatment that absorbs a liquid component from an image.

Description of the Related Art

An inkjet recording method forms an image by directly or indirectly applying a liquid composition (ink) containing a coloring material on a recording medium such as a paper. At this time, excessive absorption of a liquid component in the ink into the recording medium possibly causes a curling and a cockling. Therefore, for quick removal of the liquid component in the ink, there have been provided a method of drying a recording medium using means such as hot air and infrared and a method of forming an image on a transfer body, and then drying a liquid component contained in the image on the transfer body by heat energy and the like, and after that, transferring the image on a recording medium such as a paper. Furthermore, as means to remove a liquid component contained in an image on a transfer body, there has been proposed a method of bringing a roller-shaped porous body into contact with an ink image and absorbing and removing the liquid component from the ink image without use of heat energy (Japanese Patent Application Laid-Open No. 2009-045851).

An ink image formed with ink before removal of a liquid component contains comparatively a large amount of liquid ingredient and therefore is flexible and is likely to deform by an external force. Additionally, the liquid ingredient in the ink image is reduced and the ink image hardens during the removal of liquid; therefore, the ink image is less likely to deform by the external force. As disclosed in Japanese Patent Application Laid-Open No. 2009-045851, when the liquid is removed from the ink image, repeated use of the porous body provided with a liquid absorbing member gradually compresses and deforms the porous body by a contact pressure during the removal of the liquid, possibly deteriorating an absorption property of the liquid. For successful removal of the liquid ingredient from the ink image, it is important to absorb the liquid by the porous body while the deformation of the ink image is reduced. It has been found that the deterioration of the liquid absorption property of the porous body causes a phenomenon (hereinafter referred to as "image smearing") where a flow resistance of the liquid ingredient flowing into the porous body increases and a pressing force by the liquid absorbing member presses and flows the liquid ingredient in the ink image to an ink image rear end side. The present invention has been made in the light of such related art. An object of the present invention is to provide an inkjet recording method and an apparatus configured to evaluate a change in a state of a porous body and perform an appropriate processing according to the state of the porous body even when the porous body is repeatedly used to absorb a liquid ingredient from an image formed by an ink and a reaction liquid for increasing a viscosity of the ink.

SUMMARY OF THE INVENTION

An inkjet recording method according to the present invention includes an ink image forming step, a liquid absorbing step, a contact information storing step, and a gas permeability evaluating step. The ink image forming step applies an ink and a reaction liquid for increasing a viscosity of the ink to an ejection target medium to form an ink image on the ejection target medium. The ink contains an aqueous liquid component and a coloring material and is discharged by an inkjet method. The ink image contains the aqueous liquid component and the coloring material. The liquid absorbing step brings a liquid absorbing surface of a porous body into contact with the ink image formed on the ejection target medium to absorb at least a part of the aqueous liquid component from the ink image by the porous body. The porous body is used in the liquid absorbing step repeatedly. The contact information storing step stores contact information in an information storage medium. The contact information includes the number of contact times to an ink image of the liquid absorbing surface of the porous body used in the liquid absorbing step and a contact pressure applied to the liquid absorbing surface of the porous body in each contact. The gas permeability evaluating step evaluates a state of gas permeability of the porous body based on the contact information and a specific parameter regarding a gas permeability of the porous body. An inkjet recording apparatus according to the present invention includes an ink image forming unit, a liquid absorber unit, a transport mechanism, an apparatus operation control section, a contact information storing section, and a gas permeability state evaluating section. The ink image forming unit is configured to apply an ink and a reaction liquid for increasing a viscosity of the ink to an ejection target medium to form an ink image on the ejection target medium. The ink contains an aqueous liquid component and a coloring material and is discharged by an inkjet method. The ink image contains the aqueous liquid component and the coloring material. The liquid absorber unit has a liquid absorbing member in a liquid absorption treatment region. The liquid absorbing member includes a porous body for absorbing at least a part of the aqueous liquid component from the ink image via a liquid absorbing surface thereof to be brought into contact with the ink image. The transport mechanism is configured to carry out the porous body from the liquid absorption treatment region and carry back the porous body to the liquid absorption treatment region. The apparatus operation control section is configured to control operation of the ink image forming unit, the liquid absorber unit and the transport mechanism. The contact information storing section stores contact information. The contact information includes the number of contact times to an ink image of the liquid absorbing surface of the porous body and a contact pressure applied to the liquid absorbing surface of the porous body in each contact. The porous body is carried back to the liquid absorption treatment region by the transport mechanism. The gas permeability state evaluating section is configured to evaluate a state of gas permeability of the porous body based on the contact information and a specific parameter regarding a gas permeability of the porous body.

Further features of the present invention will become apparent from the following description of exemplary embodiments with reference to the attached drawings.

DESCRIPTION OF THE EMBODIMENTS

Figure 1:
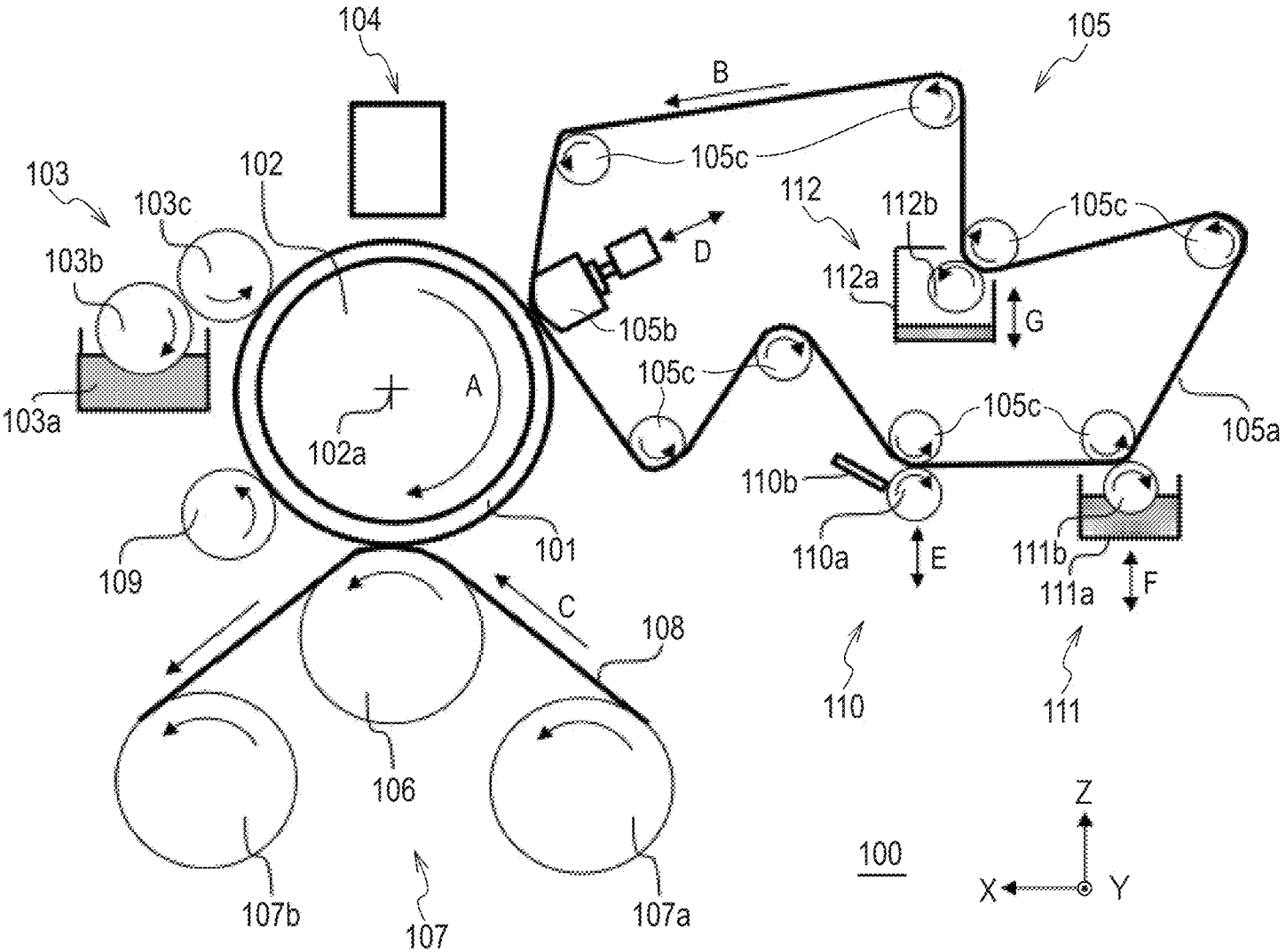
FIG. 1 is a schematic diagram illustrating one example of a configuration of a transfer type inkjet recording apparatus according to one embodiment of the present invention.

Preferred embodiments of the present invention will now be described in detail in accordance with the accompanying drawings.

An inkjet recording method according to the present invention includes the following steps.

(1) An image forming step applies an ink and a reaction liquid for increasing a viscosity of the ink to an ejection target medium (a recorded body) to form an (ink) image. The ink contains an aqueous liquid component and a coloring material. The image contains the aqueous liquid component and the coloring material.

(2) A liquid absorbing step performs a liquid absorbing treatment in a liquid absorption treatment region. The liquid absorbing treatment brings a liquid absorbing surface (a surface for liquid absorption) of a porous body into contact with the image to absorb at least a part of the aqueous liquid component from the image by the porous body.

(3) A step repeatedly uses the porous body in the liquid absorbing step.

(4) A contact information storing step stores contact information in an information storage medium. The contact information includes the number of contact times to an image of the liquid absorbing surface of the porous body used in the liquid absorbing step and a contact pressure applied to the liquid absorbing surface of the porous body in each contact.

(5) A gas permeability evaluating step evaluates a state of gas permeability of the porous body based on the contact information and a specific parameter regarding a gas permeability of the porous body.

An inkjet recording apparatus according to the present invention includes the following units or components:

(A) An ink image forming unit configured to apply an ink and a reaction liquid for increasing a viscosity of the ink to an ejection target medium to form an image. The ink contains an aqueous liquid component and a coloring material. The image contains the aqueous liquid component and the coloring material.

(B) A liquid absorber unit having a liquid absorbing member including a porous body in a liquid absorption treatment region. The liquid absorbing member includes a porous body for absorbing at least a part of the aqueous liquid component from the image via a liquid absorbing surface thereof to be brought into contact with the image.

(C) A transport mechanism (unit) configured to carry out the porous body from the liquid absorption treatment region and carry back the porous body to the liquid absorption treatment region.

(D) An apparatus operation control section configured to control operation of the ink image forming unit, the liquid absorber unit, and the transport mechanism.

(E) A contact information storing section that stores contact information. The contact information includes the number of contact times to an ink image of the liquid absorbing surface of the porous body and a contact pressure applied to the liquid absorbing surface of the porous body in each contact. The porous body is carried back to the liquid absorption treatment region by the transport mechanism.

(F) A gas permeability state evaluating section configured to evaluate a state of gas permeability of the porous body based on the contact information and a specific parameter regarding a gas permeability of the porous body.

The ink is applied to the ejection target medium by an inkjet method. According to the present invention, the state regarding the gas permeability of the porous body is evaluated from the contact information that includes the number of contact times and the contact pressure to the image stored in the contact information storing section and a processing regarding the porous body can be appropriately performed. Thus, the highly-reliable inkjet recording method and recording apparatus can be provided. The repeated use of the porous body for absorption and removal of a liquid ingredient from the image deteriorates a liquid absorption function and possibly causes image smearing. The present invention can evaluate the state regarding the gas permeability of the porous body, predict a timing of generating image smearing, and perform the processing regarding the porous body at an appropriate timing.

With the inkjet recording apparatus according to the present invention, as long as the ink image forming unit (the image forming unit) can form the image (the ink image) containing the aqueous liquid component and the coloring material on the ejection target medium, the ink image forming unit is not specifically limited. An image formed by the image forming unit and on which the liquid absorbing treatment by the liquid absorbing member has not yet been performed is also referred to as an "ink image before removal of liquid." Moreover, an image on which the liquid absorbing treatment has been performed and the content of the aqueous liquid component has been lowered is also referred to as an "ink image after removal of liquid." The image as a liquid absorbing treatment target is formed by applying the reaction liquid and the ink over the ejection target medium such that at least a region where the reaction liquid overlaps with the ink is formed. The reaction liquid promotes and improves fixability of the coloring material applied together with the ink on the ejection target medium. These promotion and improvement of the fixability of the coloring material means a state where an initial state in which the ink applied over the ejection target medium has fluidity becomes a state in which an action of the reaction liquid lowers the fluidity of the ink itself or the coloring material in the ink and the ink increases viscosity compared with the viscosity in the initial state and is fixed so as to be less likely to flow. The mechanism will be described later. The image formed by the image forming unit is formed containing a mixture of the reaction liquid and the ink. The ink contains the aqueous liquid component containing water, and the reaction liquid also contains the aqueous liquid component containing water as necessary. Therefore, the image contains the aqueous liquid component containing the water supplied from these aqueous liquid mediums together with the coloring material. An inkjet recording device is used as an ink applicator device applying the ink on the ejection target medium. The reaction liquid can contain a component that chemically or physically acts with the ink, thickens the viscosity of the mixture of the reaction liquid and the ink more than each viscosity of the reaction liquid and the ink, and improves the fixability of the coloring material. The reaction liquid can contain the aqueous liquid medium. The aqueous liquid medium at least contains water and contains water-soluble organic solvent and various additives as necessary. Assuming the water as first liquid, at least one of the reaction liquid and the ink can contain second liquid other than the first liquid. Although high and low of volatile of the second liquid does not matter, the second liquid is preferably liquid having volatile higher than that of the first liquid.

The following describes one embodiment of the present invention.

<Reaction Liquid Applicator Device>

The reaction liquid applicator device may be any device that can apply the reaction liquid on the ejection target medium and conventionally known various devices are usable appropriately. Specifically, the device includes a gravure offset roller, an inkjet head, a die coater, a blade coater, and the like. As long as the reaction liquid can be mixed with (react to) the ink on the ejection target medium, the reaction liquid applicator device may apply the reaction liquid before applying the ink or after applying the ink. The reaction liquid is preferably applied before applying the ink. By applying the reaction liquid before applying the ink, a bleeding where the applied adjacent inks are mixed with one another and a beading where previously landed ink is attracted to ink landed later during an image recording by an inkjet method can be reduced.

<Reaction Liquid>

The reaction liquid contains a component (an ink-viscosity-increasing component) that increases the viscosity of the ink. The increased viscosity of the ink includes the case where the coloring material, resin, or a similar material as a part of the composition constituting the ink contacts the ink-viscosity-increasing component to chemically react to or is physically absorbed, and by this action, an increase in viscosity of the entire ink is observed and the case where a partial aggregation of the component constituting the ink such as the coloring material locally increases the viscosity. This ink-viscosity-increasing component lowers the fluidity of the ink and/or some of the ink compositions on the ejection target medium, thus providing an effect of reducing the bleeding and the beading during the image formation with the ink. As such ink-viscosity-increasing component, known material such as polyvalent metal ion, organic acid, cationic polymer, and porous microparticles are usable. Among the materials, the polyvalent metal ion and the organic acid are especially preferable. Containing a plurality of kinds of ink-viscosity-increasing components is also preferable. A content of the ink-viscosity-increasing component in the reaction liquid is preferably 5 mass % or more with respect to the total mass of the reaction liquid. Examples of the polyvalent metal ion include divalent metal ion such as $Ca^{2+}$, $Cu^{2+}$, $Ni^{2+}$, $Mg^{2+}$, $Sr^{2+}$, $Ba^{2+}$, and $Zn^{2+}$ and trivalent metal ion such as $Fe^{3+}$, $Cr^{3+}$, $Y^{3+}$, and $Al^{3+}$. Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridinecarboxylic acid, coumalic acid, thiophenecarboxylic acid, nicotine acid, oxysuccinic acid, and dioxysuccinic acid. The reaction liquid can contain water and low-volatile organic solvent by an appropriate amount. The water used in this case is preferably deionized water by ion exchange or a similar method. The organic solvent usable for the reaction liquid applied to the present invention is not especially limited, and the known organic solvent is usable. The reaction liquid can be used by adding surfactant and viscosity modifier and appropriately adjusting the surface tension and the viscosity. As long as the material can coexist with the ink-viscosity-increasing component, the used material is not specifically limited. Specifically, examples of the used surfactant include acetylene glycol ethylene oxide adduct (product name: "Acetylenol E100," trade name manufactured by Kawaken Fine Chemicals) and perfluoroalkyl ethylene oxide adduct (product name: "Megaface F444," trade name manufactured by DIC).

<Ink Applicator Device>

This embodiment uses an inkjet head as the ink applicator device applying the ink. Configurations of the inkjet head include, for example, a configuration that generates film boiling in the ink by an electrothermal transducer and forms air bubbles to discharge the ink, a configuration that discharges the ink by an electromechanical transducer, and a configuration that discharges the ink using static electricity. This embodiment can use the known inkjet head. Among the configurations, the configuration using the electrothermal transducer is especially preferably used in terms of high-speed, high-density printing. The drawing is performed by receiving an image signal and applying an amount of ink required at each position. Although an ink applied amount is expressible by an image density (duty) and an ink thickness, this embodiment employs an average value found by multiplying a mass of each ink dot by an application count and dividing the found value by a printed area as the ink applied amount ($g/m^2$). The maximum ink applied amount in an image region indicates the ink applied amount applied in an area of at least 5 $mm^2$ or more in a region used as information of the ejection target medium from an aspect of removing the liquid component in the ink. The ink applicator device may include a plurality of inkjet heads to apply color ink in each color on the ejection target medium. For example, to form each color image using yellow ink, magenta ink, cyan ink, and black ink, the ink applicator device includes the four inkjet heads each discharges the above-described four kinds of inks on the ejection target medium, and the inkjet heads are disposed so as to be aligned in an X-direction (an ejection target medium conveyance direction). The ink applicator device may include an inkjet head that discharges clear ink actually transparent that does not contain the coloring material or contains but the proportion is considerably low. This clear ink is usable for formation of an ink image together with the reaction liquid and the color ink. For example, this clear ink can be used to improve a gloss of the image. A resin component to be combined may be appropriately adjusted so as to provide the gloss to the image, and further the discharge position of the clear ink may be regulated. Since this clear ink is desirable to be on a surface layer side with respect to the color inks in a final recorded material, a transfer body type recording apparatus applies the clear ink on the transfer body prior to the color inks. Therefore, the inkjet head for clear ink can be disposed on the upstream side with respect to the inkjet heads for color inks in a moving direction of a transfer body 101 opposed to the ink applicator device. Additionally, separately from the ink for gloss, the clear ink is usable to improve transferability of the image from the transfer body to a recording medium. For example, by containing a large amount of component that develops the viscosity more than those of the color inks in the clear ink and applying the clear ink over the color inks, the clear ink is usable as transferability improving liquid applied on the transfer body. For example, an inkjet head for the clear ink for improvement of transferability is disposed downstream with respect to the inkjet heads for color inks in the moving direction of the transfer body 101 opposed to the ink applicator device. The color ink is applied over the transfer body, and then the clear ink is applied on the transfer body after the color ink is applied. This makes the clear ink present on an outermost surface of the ink image. The clear ink on the surface of the ink image adheres to the recording medium with a certain amount of adhesive force in the transfer of the ink image to the recording medium at the transfer section, and this facilitates movement of the ink image after the removal of liquid to the recording medium.

The following describes each component of the ink applied to this embodiment.

<Ink>

(Coloring Material)

As the coloring material contained in the ink applied to this embodiment, pigment or a mixture of dye and pigment is usable. The kind of the pigment usable as the coloring material is not especially limited. The specific examples of the pigment can include inorganic pigment such as carbon black; and organic pigment such as azo-based, phthalocyanine-based, quinacridone-based, isoindolinone-based, imidazolone-based, diketopyrrolopyrrole-based, and dioxazine-based pigments. One kind or two or more kinds of these pigments are usable as necessary. The kind of the dye usable as the coloring material is not especially limited. Specific examples of the dye can include direct dye, acid dye, basic dye, disperse dye, and food dye, and dye having an anionic group is usable. Specific examples of a dye skeleton include an azo skeleton, a triphenylmethane skeleton, a phthalocyanine skeleton, an azaphthalocyanine skeleton, a xanthene skeleton, and an anthrapyridone skeleton. The content of the pigment in the ink is preferable to be 0.5 mass % or more to 15.0 mass % or less with respect to the total mass of the ink, and is more preferable to be 1.0 mass % or more to 10.0 mass % or less.

(Coloring Material)

As the coloring material contained in the ink applied to the present invention, pigment or a mixture of dye and pigment is usable. The kind of the pigment usable as the coloring material is not especially limited. The specific examples of the pigment can include inorganic pigment such as carbon black; and organic pigment such as azo-based, phthalocyanine-based, quinacridone-based, isoindolinone-based, imidazolone-based, diketopyrrolopyrrole-based, and dioxazine-based pigments. One kind or two or more kinds of these pigments are usable as necessary. The kind of the dye usable as the coloring material is not especially limited. Specific examples of the dye can include direct dye, acid dye, basic dye, disperse dye, and food dye, and dye having an anionic group is usable. Specific examples of a dye skeleton include an azo skeleton, a triphenylmethane skeleton, a phthalocyanine skeleton, an azaphthalocyanine skeleton, a xanthene skeleton, and an anthrapyridone skeleton. The content of the pigment in the ink is preferable to be 0.5 mass % or more to 15.0 mass % or less with respect to the total mass of the ink, and is more preferable to be 1.0 mass % or more to 10.0 mass % or less.

(Dispersing Agent)

As the dispersing agent dispersing the pigment, the known dispersing agent used for the ink for inkjet is usable. Among the dispersing agents, the use of a water-soluble dispersing agent having both a hydrophilic part and a hydrophobic part in a structure is preferable for the aspect of this embodiment. Especially, a pigment dispersing agent made of resin produced by copolymerization containing at least hydrophilic monomers and hydrophobic monomers is preferably used. Each monomer used here is not specifically limited, and the known monomers are preferably used. Specifically, examples of the hydrophobic monomer include styrene and other styrene derivatives, alkyl(meth)acrylate, and benzyl(meth)acrylate. Additionally, examples of the hydrophilic monomer include acrylic acid, methacrylic acid, and maleic acid. This dispersing agent preferably has an acid value of 50 mgKOH/g or more to 550 mgKOH/g or less. This dispersing agent preferably has a weight average molecular weight of 1000 or more to 50000 or less. A mass ratio (pigment:dispersing agent) of the pigment to the dispersing agent is preferably in the range of 1:0.1 to 1:3. The use of so-called self-dispersing pigment that allows dispersion by surface reforming of the pigment itself without the use of the dispersing agent is preferable in this embodiment.

(Resin Microparticles)

The ink applied to this embodiment is usable by containing various microparticles not containing the coloring material. Among the microparticles, the resin microparticles provide effects in improvement of image quality and fixability in some cases and therefore are preferable. The material of the resin microparticles usable for this embodiment is not especially limited and the known resin is usable appropriately. The material is specifically a homopolymerization product such as polyolefin, polystyrene, polyurethane, polyester, polyether, polyurea, polyamide, polyvinyl alcohol, poly(meth)acrylic acid and its salt, poly(meth)alkyl acrylate, and polydiene, or a copolymerization product produced through polymerization of a combination of a plurality of monomers to generate these homopolymerization products. This resin has the weight average molecular weight (Mw) preferably in a range of 1,000 or more to 2,000,000 or less. The amount of resin microparticles in the ink is preferable to be 1 mass % or more to 50 mass % or less with respect to the total mass of the ink and more preferable to be 2 mass % or more to 40 mass % or less. Further, the resin microparticles are preferably used as a resin microparticle dispersing element in which these resin microparticles are dispersed in the liquid for the aspect of this embodiment. Although the method for dispersion is not especially limited, so-called self-dispersion type resin microparticle dispersing element in which resin produced by homopolymerization of monomers having a dissociable group or copolymerization of a plurality of kinds of monomers having a dissociable group is dispersed is preferable. Here, examples of the dissociable group include a carboxyl group, a sulfonic acid group, and a phosphate group, and examples of the monomer having this dissociable group include acrylic acid and methacrylic acid. Additionally, so-called emulsification dispersing type resin microparticle dispersing element in which resin microparticles are dispersed with emulsifier is also similarly usable preferable for this embodiment. The emulsifier here is preferably known surfactant regardless of a low molecular weight and a high molecular weight. This surfactant is preferably nonionic surfactant or surfactant having electric charges identical to those of the resin microparticles. The resin microparticle dispersing element used for the aspect of this embodiment preferably has a dispersed particle diameter of 10 nm or more to 1000 nm or less and more preferably has a dispersed particle diameter of 100 nm or more to 500 nm or less. Various additives are preferably added for stabilization when the resin microparticle dispersing element used for the aspect of this embodiment is produced. Examples of this additive include n-hexadecane, dodecyl methacrylate, stearyl methacrylate, chlorobenzene, dodecyl mercaptan, blue dye (bluing agent), and polymethyl methacrylate.

(Surfactant)

The ink usable for this embodiment may contain the surfactant. Examples of the surfactant specifically include acetylene glycol ethylene oxide adduct (ACETYLENOL E100 manufactured by Kawaken Fine Chemicals). The amount of surfactant in the ink is preferably 0.01 mass % or more to 5.0 mass % or less with respect to the total mass of the ink.

(Water and Water-Soluble Organic Solvent)

The ink used for this embodiment can contain water and/or the water-soluble organic solvent as the solvent. The water is preferably deionized water by ion exchange or a similar method. The content of water in the ink is preferably 30 mass % or more to 97 mass % or less with respect to the total mass of the ink. The kind of the used water-soluble organic solvent is not especially limited and any known organic solvent is usable. Examples of the water-soluble organic solvent specifically include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrolidone, ethanol, and methanol. Needless to say, a mixture of two kinds or more materials selected from these materials is also usable. Moreover, the content of the water-soluble organic solvent in the ink is preferably 3 mass % or more to 70 mass % or less with respect to the total mass of the ink.

(Other Additives)

Various additives such as a pH adjuster, a rust inhibitor, an antiseptic, an antifungal agent, an antioxidant, a reduction inhibitor, water-soluble resin and the neutralizer, and viscosity modifier may be contained in the ink usable for this embodiment as necessary in addition to the above-described components.

<Liquid Absorbing Member>

This embodiment contacts at least a part of the liquid component from the ink image before the removal of the liquid with the liquid absorbing member including the porous body to absorb and remove the liquid and to reduce the content of the liquid component in the ink image. A surface of the liquid absorbing member in contact with the ink image is referred to as a first surface and the porous body is disposed on the first surface. Such liquid absorbing member including the porous body preferably has a shape with which the porous body can cyclically absorb the liquid where the porous body moves in conjunction with the movement of the ejection target medium, is in contact with the ink image, and then re-contacts another ink image before the removal of liquid at predetermined cycle. Examples of the shape include an endless belt shape and a drum shape.

(Porous Body)

The porous body having an average hole diameter on the first surface side smaller than an average hole diameter on the second surface side, which is opposed to the first surface, is preferably used as the porous body of the liquid absorbing member according to this embodiment. The small hole diameter is preferable to reduce an attachment of the coloring material in the ink to the porous body, and the average hole diameter of the porous body on the first surface side in contact with the image is preferably at least 10 μm or less. Note that, in this embodiment, the average hole diameter indicates the average diameter of the surface of the first surface or the second surface and is measurable by the known means, for example, a mercury penetration method, a nitrogen adsorption method, and a SEM image observation. The thickness of the porous body is preferably thinned for uniform, high gas permeability. The gas permeability can be indicated by a Gurley value defined in JIS P8117, and the Gurley value is preferably 10 seconds or less. However, there may be a case where thinning the porous body fails to sufficiently secure a capacity required to absorb the liquid component; therefore, configuring the porous body into a multi-layer is possible. It is only necessary that the layer of the liquid absorbing member in contact with the ink image is the porous body, and the layer not in contact with the ink image needs not to be the porous body. The following describes an embodiment configuring the porous body into the multi-layer. Here, the description will be given defining a layer on the side in contact with the ink image as a first layer and a layer stacked on a surface opposite to the contact surface of the first layer with the ink image as a second layer. Furthermore, the layers of the multi-layer configuration are also described sequentially in the order of stack from the first layer. Note that this description sometimes designates the first layer as an "absorbing layer" and the second layer and the subsequent layers as "support layers."

[First Layer]

In this embodiment, the material of the first layer is not specifically limited. Both of a hydrophilic material with a contact angle with respect to water of less than 90° and a water-repellent material with a contact angle of 90° or more are usable. The hydrophilic material is preferably selected from a single material such as cellulose and polyacrylamide, a composite material of these materials, and the like. One produced through a hydrophilic treatment on the surface of the following water-repellent materials is also usable. Examples of a method of the hydrophilic treatment include a spatter etching method, a radiation, $H_2O$ ion irradiation, and excimer (ultraviolet rays) laser beam irradiation. With the hydrophilic material, the contact angle with respect to the water is more preferable to be 60° or less. The hydrophilic material provides an effect of absorbing up liquid, especially the water, by a capillary force. Meanwhile, to reduce the attachment of the coloring material and increase cleaning ability, the material of the first layer is preferably a water-repellent material with low surface free energy, and fluororesin is especially preferable. Examples of the fluororesin specifically include polytetrafluoroethylene (PTFE), polychlorotrifluoroethylene (PCTFE), polyvinylidene fluoride (PVDF), polyvinyl fluoride (PVF), perfluoroalkoxy fluorine resin (PFA), ethylene tetrafluoride.propylene hexafluoride copolymer (FEP), ethylene.ethylene tetrafluoride copolymer (ETFE), and ethylene chlorotrifluoroethylene copolymer (ECTFE). One kind or two or more kinds of these resins is usable as necessary, and a configuration in which a plurality of films are stacked in the first layer may be employed. The water-repellent material hardly has an effect of absorbing up the liquid by the capillary force and possibly requires a time to absorb up the liquid when in contact with the image for the first time. In view of this, liquid having the contact angle with the first layer of less than 90° is preferably soaked into the first layer. This liquid can be soaked into the first layer by application from the first surface of the liquid absorbing member. This liquid is preferably prepared by mixing water with surfactant and liquid having the low contact angle with the first layer. In this embodiment, the first layer preferably has the film thickness of 50 μm or less. The film thickness is more preferable to be 30 μm or less. This embodiment measured the film thickness at any given ten points by a straight motion type micrometer OMV_25 (manufactured by Mitsutoyo) and the average value was computed to obtain the film thickness. The first layer can be manufactured by a manufacturing method for the known thin porous film. For example, after obtaining a sheet-shaped material by a method such as an extrusion molding of a resin material, the sheet-shaped material is extended to have a predetermined thickness, thus ensuring obtaining the first layer. The first layer can be obtained as a porous film by adding plasticizer such as paraffin to the material during the extrusion molding and removing the plasticizer by heating or a similar method during the extension. Appropriately adjusting the additive amount, the draw ratio, and the like of the plasticizer to be added ensures adjusting the hole diameter.

[Second Layer]

In this embodiment, the second layer preferably a layer having gas permeability. Such layer may be a nonwoven fabric or may be a woven fabric made of resin fiber. Although the material of the second layer is not especially limited, a material with a contact angle equivalent to or lower than the contact angle of the first layer with respect to the first liquid is preferable so as not to flow the liquid absorbed into the first layer side backward. Specifically, the material of the second layer is preferably selected from a single material such as polyolefin (such as polyethylene (PE) and polypropylene (PP)), polyamide such as polyurethane and nylon, polyester (such as polyethylene terephthalate (PET)), and polysulfone (PSF), or a composite material of these materials, and the like. The second layer is preferably a layer having a hole diameter larger than that of the first layer.

[Third Layer]

In this embodiment, the porous body with the multi-layer structure may have a configuration of three or more layers, and the configuration is not limited. A nonwoven fabric is preferable in terms of rigidity as the third layer and the subsequent layers. The material similar to that of the second layer is used.

[Other Materials]

The liquid absorbing member may include a reinforcing member that reinforces side surfaces of the liquid absorbing member in addition to the porous body having the above-described stacked structure. The liquid absorbing member may include a joining member to produce a belt-shaped member by connecting end portions of the long sheet-shaped porous body in the longitudinal direction. A non-porous tape material and the like are usable as such material, and the joining member only needs to be disposed at a position or a cycle not in contact with the image.

[Method for Manufacturing Porous Body]

The method for forming the porous body by stacking the first layer and the second layer is not especially limited. The first layer and the second layer may be simply stacked together, or may be adhered to one another by a method such as an adhesive lamination or a heat lamination. In terms of gas permeability, the heat lamination is preferable in this embodiment. For example, a part of the first layer or the second layer may be melted for adhesion and stacking by heating. Alternatively, a fusion material such as hot melt powder may be interposed between the first layer and the second layer for adhesion and stacking to one another by heating. For stacking of the third layer or more layers, the layers may be stacked once or may be stacked sequentially, and the order of the stacking is appropriately selected. A lamination method that heats the porous body while applying a pressure on the porous body sandwiched by heated rollers is preferable for the heating step.

The following describes specific examples of embodiments of the inkjet recording apparatus according to the present invention. Apparatuses of the following systems can be included as the inkjet recording apparatus of the present invention. (A) The inkjet recording apparatus that forms an image (an ink image before removal of liquid) on the transfer body as the ejection target medium and transfers an image (an ink image after the removal of liquid) after absorption of the liquid component by the liquid absorbing member to the recording medium (B) The inkjet recording apparatus that forms an image on the recording medium as the ejection target medium In the present invention, the former inkjet recording apparatus is hereinafter referred to as a transfer type inkjet recording apparatus for convenience, and the latter inkjet recording apparatus is hereinafter referred to as a direct drawing type inkjet recording apparatus for convenience. In the transfer type inkjet recording apparatus, the transfer body temporarily holds the image on the image formation surface, the image temporarily held on the transfer body is transferred to the recording medium, and a final image is formed on the recording medium. The following describes each of the inkjet recording apparatuses.

(Transfer Type Inkjet Recording Apparatus)

FIG. 1 is a schematic diagram illustrating one example of a schematic configuration of a transfer type inkjet recording apparatus 100 according to this embodiment. This recording apparatus is a single wafer type inkjet recording apparatus that transfers an ink image to a recording medium 108 via the transfer body 101 to produce a recorded material. In this embodiment, an X-direction, a Y-direction, and a Z-direction indicate a conveyance direction (a longitudinal direction), a width direction (a depth direction), and a thickness direction (a height direction) of the recording medium 108, respectively. As illustrated in FIG. 1, the transfer type inkjet recording apparatus 100 of the present invention includes the transfer body 101 supported by a supporting member 102, a reaction liquid applicator device 103, an ink applicator device 104, a liquid absorber device (a liquid absorber unit) 105, and a pressing member 106 for transfer. The reaction liquid applicator device 103 applies the reaction liquid reacting to color ink on the transfer body 101. The ink applicator device 104 applies colored ink on the transfer body 101 over which the reaction liquid has been applied and includes an inkjet head, which forms an ink image as an image by the ink on the transfer body. The liquid absorber device 105 absorbs the liquid component from the ink image on the transfer body. The pressing member 106 is to transfer the ink image on the transfer body from which the liquid component has been removed on the recording medium 108 such as a paper. In this embodiment, the pressing member 106 for transfer, the supporting member 102 of the transfer body 101, and a recording medium conveyer device 107 form a transfer unit. The transfer type inkjet recording apparatus 100 may include a transfer body cleaning member 109 that cleans the surface of the transfer body 101 after transfer as necessary. Furthermore, the liquid absorber device 105 may include a liquid absorbing member cleaning device 110, which cleans a surface of a liquid absorbing member 105*a*, and a pretreatment device 111, which includes a pretreatment liquid container 111*a* and a pretreatment liquid applying member (an offset roller) 111*b* and applies pretreatment liquid over the liquid absorbing member 105*a*. Further, the liquid absorber device 105 may include a liquid holding amount adjustment device 112, which includes a liquid holding amount adjusting member 112*b* and an excess liquid container 112*a* and adjusts the amount of liquid held by the liquid absorbing member 105*a* so as to be an appropriate amount. Needless to say, the transfer body 101, the reaction liquid applicator device 103, the inkjet head of the ink applicator device 104, the liquid absorber device 105 and the transfer body cleaning member 109, the liquid absorbing member cleaning device 110, the pretreatment device 111, and the liquid holding amount adjustment device 112 each has a length corresponding to the used recording medium 108 in the Y-direction. The transfer body 101 rotates around a rotation axis 102*a* of the supporting member 102 in an arrow A direction of FIG. 1. The rotation of this supporting member 102 moves the transfer body 101. The reaction liquid and the ink are sequentially applied on the moving transfer body 101 by the reaction liquid applicator device 103 and the ink applicator device 104, respectively, thus forming the ink image on the transfer body 101. The movement of the transfer body 101 moves the ink image formed on the transfer body 101 up to a position in contact with the liquid absorbing member 105*a* that the liquid absorber device 105 has.

The transfer body 101 and the liquid absorber device 105 move synchronized with the rotation of the transfer body 101 and the liquid absorber device rotates in an arrow B direction of FIG. 1. The ink image formed on the transfer body 101 goes through the state in contact with this moving liquid absorbing member 105*a*. In the meantime, the liquid absorbing member 105*a* removes the liquid component from the ink image on the transfer body. In this contact state, pressing the liquid absorbing member 105*a* to the transfer body 101 at a predetermined pressing force is especially preferable in terms of causing the liquid absorbing member 105*a* to function effectively. To describe the removal of the liquid component from a different viewpoint, the removal can also be expressed as a condensation of the ink constituting the image formed on the transfer body. The condensation of the ink means an increase in a content ratio of a solid content such as a coloring material and resin to the liquid component contained in the ink through the reduction in the liquid component contained in the ink. Then, the ink image after the removal of the liquid from which the liquid component has been removed becomes the state where the ink is condensed compared with the ink image before the removal of the liquid. Further, the transfer body 101 moves the ink image to a transfer section where the ink image is in contact with the recording medium 108 conveyed by the recording medium conveyer device 107. While the ink image after the removal of the liquid is in contact with the recording medium 108, pressing the transfer body 101 by the pressing member 106 transfers the ink image on the recording medium 108. The ink image after the transfer where the ink image has been transferred on the recording medium 108 is a reverse image of the ink image before the removal of the liquid and the ink image after the removal of the liquid. Since the reaction liquid is applied on the transfer body and then the ink is applied to form the image in this embodiment, the reaction liquid not reacting to the ink remains in a non-image region where the image is not formed with the ink. With this device, the liquid absorbing member 105*a* removes the liquid component not only from the image but also from the reaction liquid by contacting the unreacted reaction liquid. Accordingly, although the description is given expressing that the liquid component is removed from the image above, this does not limitedly mean that the liquid component is removed from only the image but means that it is only necessary that the liquid component be removed from at least the image on the transfer body. As long as the liquid component does not have a fixed shape and has fluidity and an approximately constant volume, the liquid component is not especially limited. For example, the water and the organic solvent contained in the ink and the reaction liquid are included as the liquid component.

The following describes each configuration of the transfer type inkjet recording apparatus according to this embodiment.

<Transfer Body>

The transfer body 101 has a surface layer including the image formation surface. While various materials such as resin and ceramic are appropriately usable as the member of the surface layer, a material with high modulus of compressive elasticity is preferable in terms of durability and a similar property. Specifically, examples of the material include a condensate obtained by a condensation of acryl resin, acrylic silicone resin, fluorine-containing resin, and a hydrolyzable organosilicon compound. A surface treatment may be performed on the surface layer and used for improvement in wettability, transferability, and a similar property of the reaction liquid. Examples of the surface treatment include a frame treatment, a corona treatment, a plasma treatment, a polishing treatment, a roughening treatment, an active energy line irradiation treatment, an ozonation, a surfactant treatment, and a silane coupling treatment. A plurality of these treatments may be combined. Any surface shape can be provided to the surface layer. The transfer body preferably has a compressible layer having a function of absorbing a pressure variation. By disposing the compressible layer, the compressible layer absorbs a deformation and disperses the variation of a local pressure variation, thus ensuring maintaining satisfactory transferability in the high-speed printing as well. Examples of the member of the compressible layer include acrylonitrile-butadiene rubber, acrylic rubber, chloroprene rubber, urethane rubber, and silicone rubber. It is preferable to produce the porous by combining a predetermined amount of vulcanizing agent, vulcanization accelerator, and the like during molding of the above-described rubber material and further combining filler such as a foaming agent, hollow microparticles, or salt as necessary. This compresses air bubbles parts involving the volume change against various pressure variations; therefore, the deformation except for the deformation in the compression direction is small, ensuring obtaining further stable transferability and durability. The porous rubber material includes a material having a continuous pore structure in which each pore is consecutive to one another and a material having an independent pore structure in which each pore is independent from one another. The present invention may employ any structure, and these structures may be used in combination. Further, the transfer body preferably has an elastic layer between the surface layer and the compressible layer. As a member of the elastic layer, various materials such as resin and ceramic are appropriately usable. In terms of a processing property and a similar property, various elastomer materials and a rubber material are preferably used. Examples of the material specifically include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. Especially, the silicone rubber, the fluorosilicone rubber, and the phenyl silicone rubber feature a small compression set and therefore are preferable in terms of dimensional stability and durability. Additionally, these materials feature a small change in elastic modulus due to temperature and therefore are also preferable in terms of transferability. Various adhesives and a double-sided adhesive tape may be used between each layer (the surface layer, the elastic layer, and the compressible layer) constituting the transfer body for fixation and holding of these layers. To reduce a lateral extension during mounting to the apparatus and retain stiffness, a reinforcing layer having high modulus of compressive elasticity may be disposed. Additionally, a woven fabric may be used as the reinforcing layer. The transfer body can be manufactured by any combination of each layer using the above-described materials. The size of the transfer body can be freely selected according to the aimed printing image size. The shape of the transfer body is not specifically limited, and specific examples of the shape include a sheet shape, a roller shape, a belt shape, and an endless web shape.

<Supporting Member>

The transfer body 101 is supported on the supporting member 102. As a method for supporting the transfer body, various adhesives and the double-sided adhesive tape may be used. Alternatively, an installation member made of, for example, metal, ceramic, and resin may be mounted to the transfer body to support the transfer body on the supporting member 102. In terms of conveyance accuracy and durability, some extent of structural strength is required for the supporting member 102. As the material of the supporting member, for example, metal, ceramic, and resin are preferably used. Among them, aluminum, iron, stainless, acetal resin, epoxy resin, polyimide, polyethylene, polyethylene terephthalate, nylon, polyurethane, silica ceramics, and alumina ceramics are especially preferably used to reduce inertia during the operation and improve responsiveness of the control, in addition to rigidity and dimensional accuracy that can endure the pressure application during the transfer. Alternatively, the use of a combination of these materials is also preferable.

<Reaction Liquid Applicator Device>

The inkjet recording apparatus according to this embodiment includes the reaction liquid applicator device 103, which applies the reaction liquid over the transfer body 101. FIG. 1 illustrates the reaction liquid applicator device 103 as a gravure offset roller that includes a reaction liquid container 103*a* housing the reaction liquid and reaction liquid applying members 103*b* and 103*c* that apply the reaction liquid in the reaction liquid container 103*a* on the transfer body 101.

<Ink Applicator Device>

The inkjet recording apparatus according to this embodiment includes the ink applicator device 104, which applies the ink over the transfer body 101. The reaction liquid and the ink are mixed on the transfer body, the reaction liquid and the ink form the ink image, and further the liquid absorber device 105 absorbs the liquid component from the ink image. In this embodiment, the inkjet head is a full line head extending in the Y-direction and nozzles are arrayed in a range covering a width of an image recorded region of the recording medium of a maximum usable size. The inkjet head has an ink discharge surface where the nozzles are open on the lower surface (the transfer body 101 side), and the ink discharge surface is opposed to the surface of the transfer body 101 with a slight clearance (around several millimeters) with the transfer body 101. The ink applicator device 104 may include a plurality of inkjet heads to apply color ink in each color on the ejection target medium. For example, to form each color image using yellow ink, magenta ink, cyan ink, and black ink, the ink applicator device includes the four inkjet heads each discharges the above-described four kinds of inks on the ejection target medium, and the inkjet heads are disposed so as to be aligned in the X-direction. The ink applicator device may include an inkjet head that discharges clear ink actually transparent that does not contain the coloring material or contains but the proportion is considerably low. This clear ink is usable for formation of an ink image together with the reaction liquid and the color ink. For example, this clear ink can be used to improve a gloss of the image. A resin component to be combined may be appropriately adjusted so as to provide the gloss to the image after transferred, and further the discharge position of the clear ink may be regulated. Since this clear ink is desirable to be on a surface layer side with respect to the color inks in a final recorded material, the transfer body type recording apparatus applies the clear ink on the transfer body 101 prior to the color inks. Therefore, the inkjet head for clear ink can be disposed on the upstream side with respect to the inkjet heads for color inks in a moving direction of the transfer body 101 opposed to the ink applicator device 104. Additionally, separately from the ink for gloss, the clear ink is usable to improve transferability of the image from the transfer body 101 to the recording medium. For example, by containing a large amount of component that develops the viscosity more than those of the color inks in the clear ink and applying the clear ink over the color inks, the clear ink is usable as transferability improving liquid applied on the transfer body 101. For example, an inkjet head for the clear ink for improvement of transferability is disposed downstream with respect to the inkjet heads for color inks in the moving direction of the transfer body 101 opposed to the ink applicator device 104. The color ink is applied over the transfer body 101, and then the clear ink is applied on the transfer body after the color ink is applied. This makes the clear ink present on an outermost surface of the ink image. The clear ink on the surface of the ink image adheres to the recording medium 108 with a certain amount of adhesive force in the transfer of the ink image to the recording medium at the transfer section, and this facilitates movement of the ink image after the removal of liquid to the recording medium 108.

<Liquid Absorber Device>

In this embodiment, the liquid absorber device 105 includes the liquid absorbing member 105*a* and a pressing member 105*b* for liquid absorption. The pressing member 105*b* for liquid absorption presses the liquid absorbing member 105*a* against the ink image on the transfer body 101. The liquid absorbing member 105*a* is conveyed by a liquid absorbing member conveying device (not illustrated), brought into contact with the transfer body 101, and retransmitted to the liquid absorption treatment region that performs the liquid absorbing treatment from the image. Thus, the liquid absorbing member 105*a* is configured so as to be repeatedly used. A position of the pressing member 105*b* with respect to the transfer body 101 is adjustable by a position control mechanism (not illustrated). For example, the pressing member 105*b* is configured to be move back and forth in an arrow D direction illustrated in FIG. 1, the liquid absorbing member 105*a* is brought into contact with the outer peripheral surface of the transfer body 101 at a timing at which liquid absorption is required, and also the liquid absorbing member 105*a* can be separated from this outer peripheral surface. The shapes of the liquid absorbing member 105*a* and the pressing member 105*b* are not specifically limited. For example, as illustrated in FIG. 1, it may be configured such that the pressing member 105*b* has a columnar shape, the liquid absorbing member 105*a* has a belt shape, and the belt-shaped liquid absorbing member 105*a* is pressed against the transfer body 101 by the columnar-shaped pressing member 105*b*. It may be configured such that the pressing member 105*b* has the columnar shape, the liquid absorbing member 105*a* has a cylindrical shape formed on the peripheral surface of the columnar-shaped pressing member 105*b*, and the cylindrical-shaped liquid absorbing member 105*a* is pressed against the transfer body by the columnar-shaped pressing member 105*b*. Considering a space inside the inkjet recording apparatus and the like, the liquid absorbing member 105*a* preferably has the belt shape in this embodiment. The liquid absorber device 105 having the belt-shaped liquid absorbing member 105*a* may include a stretching member stretching the liquid absorbing member 105*a*. In FIG. 1, reference numeral 105*c* denotes stretching rollers used as stretching members. This embodiment configures the liquid absorbing member conveying device by configuring the at least one stretching roller 105*c* as a drive roller for conveyance of the liquid absorbing member 105*a*. The configuration of the liquid absorbing member conveying device is not limited to this, and configurations of various conveyance devices are usable. In FIG. 1, while the pressing member 105*b* is also configured as a roller member rotating similar to the stretching roller, the configuration is not limited to this. In the liquid absorber device 105, the liquid absorbing member 105*a* including the porous body is pressed against and brought into contact with the ink image by the pressing member 105*b* to cause the liquid absorbing member 105*a* to absorb the liquid component contained in the ink image, thus reducing the liquid component. A method to reduce the liquid component in the ink image may be a combination of other conventionally used various methods such as a method by heating, a method of sending low-humidity air, and a decompression method, in addition to this method of brining the liquid absorbing member into contact. Additionally, these methods may be applied to the ink image after the removal of liquid where the liquid component has been reduced to further reduce the liquid component.

The following describes various conditions and configurations of the liquid absorber device 105 in detail.

(Cleaning)

In this embodiment, the liquid absorber device 105 includes the liquid absorbing member cleaning device 110, which removes an attachment to the surface of the liquid absorbing member 105*a*. A liquid absorbing member cleaning member 110*a* rotates synchronized with the operation of the liquid absorbing member 105*a* while brought into contact with the liquid absorbing member 105*a* to remove, for example, paper dust and ink unexpectedly attached to the liquid absorbing member 105*a*. The liquid absorbing member cleaning member 110*a* preferably has elasticity so as to ensure providing a nip width and a bonding strength to some extent and is preferably an elastic roller such as rubber. A cleaning blade 110*b* scrapes the attachment to the liquid absorbing member cleaning member 110*a* off. While a contact pressure of the liquid absorbing member cleaning member 110*a* is not especially limited, the contact pressure of 0.01 MPa or more allows stable removal of the attachment and therefore is preferable. The contact pressure of 1.0 MPa or less allows reducing a structural load to the device and therefore is preferable. Additionally, the liquid absorbing member cleaning device can be installed such that a movement to a position at which cleaning is performed on the liquid absorbing member 105*a* and a separation from the liquid absorbing member 105*a*, for example, a reciprocation movement in an arrow E direction illustrated in the drawing can be performed at a required timing. For example, a configuration where the liquid absorbing member cleaning device is arranged on an elevation stage (not illustrated) that can be moved up and down by an air cylinder for elevation (not illustrated) ensures the above-described reciprocation movement.

(Pretreatment)

This embodiment preferably performs the pretreatment that applies a processing liquid over the liquid absorbing member by pretreatment means before the liquid absorbing member 105*a* including the porous body is brought into contact with the ink image. The processing liquid used in this embodiment preferably contains water and water-soluble organic solvent. The water is preferably deionized water by ion exchange or a similar method. The kind of the water-soluble organic solvent is not especially limited, and any of the known organic solvents such as ethanol and isopropyl alcohol are usable. While the method for applying the processing liquid to the porous body used for the present invention is not especially limited, such as immersion, application, and liquid drop, an application method of a roller pressurization method is preferable for stable application of the processing liquid, high-speed application inside the device, and a similar purpose. FIG. 1 illustrates the pretreatment device 111 in combination of a chamber as the pretreatment liquid container 111*a* filled with pretreatment liquid and an offset roller as the pretreatment liquid applying member 111*b*. The present invention does not especially limit a timing for applying the processing liquid. To perform the pretreatment by sequentially revolving and conveying the drum-shaped or the endless web-shaped liquid absorbing member, the timing for the application of the processing liquid may be regulated appropriately. For example, the processing liquid may be applied at every round and the processing liquid is applied once in several rounds. Additionally, the pretreatment liquid applicator device can be installed such that a movement to a position at which the processing liquid is applied to the liquid absorbing member 105*a* and a separation from the liquid absorbing member 105*a*, for example, a reciprocation movement in an arrow F direction illustrated in the drawing can be performed at a required timing. For example, a configuration where the pretreatment liquid applicator device is arranged on an elevation stage (not illustrated) that can be moved up and down by an air cylinder for elevation (not illustrated) ensures the above-described reciprocation movement. In the embodiment illustrated in FIG. 1, the pretreatment device 111 can apply the pretreatment liquid over the porous body of the liquid absorbing member before the liquid absorbing member 105*a* is brought into contact with a first image. While an applied pressure of the processing liquid is not specifically limited, the applied pressure of 0.1 MPa or more can achieve the stable application of the processing liquid and the high-speed application inside the device and therefore is preferable. The pressure of 1.0 MPa or less allows reducing a structural load to the device and therefore is preferable.

(Liquid Holding Amount Adjustment)

The liquid absorber device 105 includes the liquid holding amount adjustment device 112 to maintain a liquid amount held by the liquid absorbing member 105*a* at an appropriate amount. The liquid holding amount adjusting member 112*b* rotates synchronized with the movement of the liquid absorbing member 105*a* while being brought into contact with the liquid absorbing member 105*a* and squeezes the liquid out of the liquid absorbing member 105*a*. The squeezed liquid is housed in the excess liquid container 112*a* and is processed through a discharge path (not illustrated). The liquid holding amount adjusting member 112*b* preferably has elasticity so as to ensure securing a nip width to some extent and is preferably an elastic roller such as rubber. While a contact pressure of the liquid holding amount adjusting member 112*b* is not especially limited, the contact pressure of 0.01 MPa or more allows stable removal of the liquid unnecessary held to the liquid absorbing member 105*a* and therefore is preferable. The contact pressure of 1.0 MPa or less allows reducing a structural load to the device and therefore is preferable. Additionally, the liquid holding amount adjustment device can be installed such that a movement to a position at which the liquid holding amount of the liquid absorbing member 105*a* is adjusted and a separation from the liquid absorbing member 105*a*, for example, a reciprocation movement in an arrow G direction illustrated in the drawing can be performed at a required timing. For example, a configuration where the liquid holding amount adjustment device is arranged on an elevation stage (not illustrated) that can be moved up and down by an air cylinder for elevation (not illustrated) ensures the above-described reciprocation movement.

(Pressure Application Condition)

A pressure of the liquid absorbing member when in contact with the ink image on the transfer body of 0.29 MPa (3 kgf/cm$^2$) or more allows solid-liquid separation of the liquid component in the ink image in a further short period. This ensures removing the liquid component in the ink image and therefore is preferable. The pressure of the liquid absorbing member in this description indicates a nip pressure between the ejection target medium and the liquid absorbing member. The pressure value is computed by measuring a surface pressure using a surface pressure distribution measuring device (trade name: "I-SCAN," manufactured by Nitta) and dividing a weight at a pressure applied region by the area.

(Action Period)

The action period to bring the liquid absorbing member 105*a* into contact with the ink image is preferably within 50 ms to further reduce an attachment of the coloring material in the ink image to the liquid absorbing member. The action period in this description is computed by dividing a pressure sensing range in the moving direction of the ejection target medium in the above-described contact pressure measurement by the moving speed of the ejection target medium. This action period is hereinafter referred to as a liquid absorption nip time. Thus, the ink image from which the liquid component has been absorbed and reduced is formed on the transfer body 101. Next, this ink image after the removal of the liquid is transferred on the recording medium 108 at the transfer section as a contact portion of the pressing member 106 for transfer and the transfer body 101. The following describes a device configuration and conditions during the transfer.

<Pressing Member for Transfer>

This embodiment brings the ink image after the removal of the liquid on the transfer body 101 into contact with the recording medium 108 conveyed by the recording medium conveyer device 107 by the pressing member 106 for transfer, thus transferring the ink image to the recording medium 108. Transferring the ink image to the recording medium 108 after removing the liquid component contained in the ink image on the transfer body 101 allows obtaining a recorded image where curling, cockling, and the like are reduced. In terms of conveyance accuracy and durability of the recording medium 108, some extent of structural strength is required for the pressing member 106. As the material of the pressing member 106, for example, metal, ceramic, and resin are preferably used. Among them, aluminum, iron, stainless, acetal resin, epoxy resin, polyimide, polyethylene, polyethylene terephthalate, nylon, polyurethane, silica ceramics, and alumina ceramics are especially preferably used to reduce inertia during the operation and improve responsiveness of the control, in addition to rigidity and dimensional accuracy that can endure the pressure application during the transfer. Alternatively, the use of a combination of these materials may be used. While a pressing time during which the pressing member 106 presses the transfer body for transfer of the ink image after the removal of the liquid on the transfer body 101 to the recording medium 108 is not specifically limited, 5 ms or more to 100 ms or less is preferable to perform the transfer properly and avoid deterioration of durability of the transfer body. The pressing time of this embodiment indicates a period during which the recording medium 108 is in contact with the transfer body 101. A surface pressure is measured using a surface pressure distribution measuring device ("I-SCAN," manufactured by Nitta), and a length of the pressure applied region in a conveyance direction is divided by the conveyance velocity, thus computing the value of the pressing time. The pressure of the pressing member 106 pressing the transfer body 101 to transfer the ink image after the removal of the liquid on the transfer body 101 to the recording medium 108 is not especially limited as long as the transfer is properly performed and the deterioration of durability of the transfer body is avoided. Therefore, the pressure is preferably 0.1 MPa or more to 3.0 MPa or less. The pressure in this embodiment indicates a nip pressure between the recording medium 108 and the transfer body 101. The pressure value is computed by measuring a surface pressure using a surface pressure distribution measuring device and dividing a weight at a pressure applied region by the area. While a temperature when the pressing member 106 presses the transfer body 101 for transfer of the ink image after the removal of the liquid on the transfer body 101 to the recording medium 108 is not specifically limited, the temperature is preferably a glass transition point or more or a softening point or more of the resin component contained in the ink. The aspect of the heating preferably includes heating means that heats a second image on the transfer body 101, the transfer body 101, and the recording medium 108. While the shape of the transfer body 101 is not specifically limited, an example of the shape includes a roller shape.

<Recording Medium and Recording Medium Conveyer Device>

This embodiment does not especially limit the recording medium 108 and any known recording medium is usable. The recording medium includes a long object wound into a roll shape or a single wafer cut into predetermined dimensions. Examples of the material include a paper, a plastic film, a wooden board, a corrugated cardboard, and a metal film. While the recording medium conveyer device 107, which conveys the recording medium 108, is constituted of a recording medium feeding roller 107*a* and a recording medium winding roller 107*b* in FIG. 1, it is only necessary that the recording medium conveyer device 107 can convey the recording medium and the configuration is not specifically limited to this.

<Control System>

Figure 3:
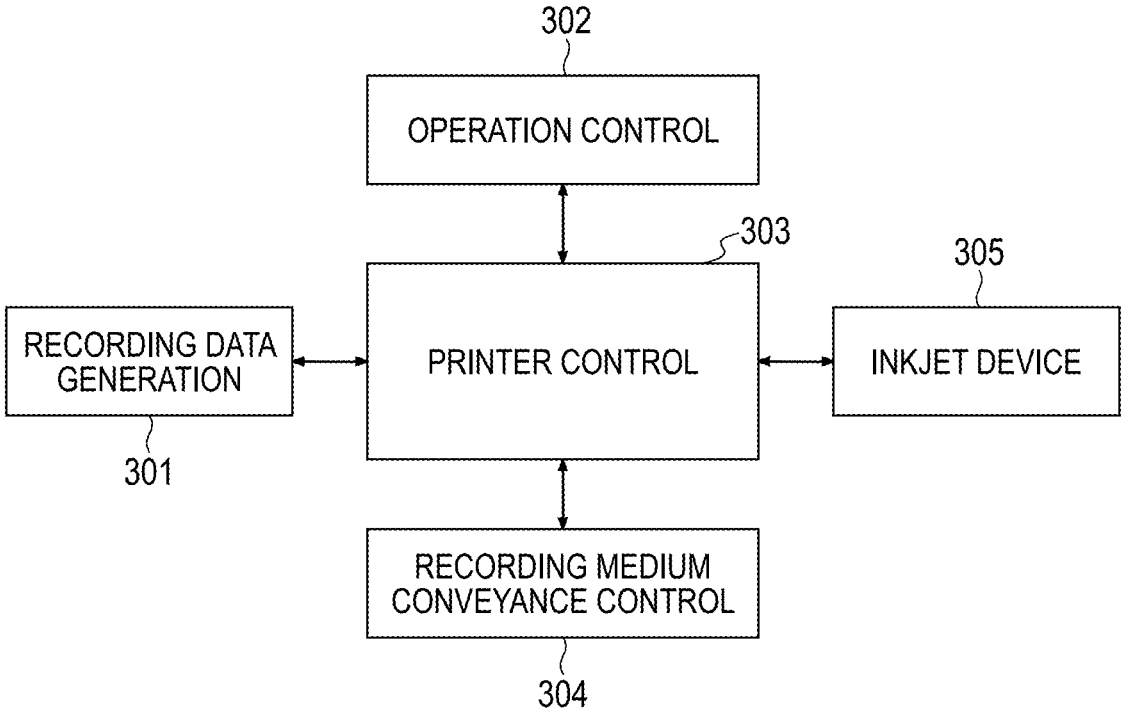
FIG. 3 is a block diagram illustrating a control system of an entire apparatus in the inkjet recording apparatuses illustrated in FIG. 1 and FIG. 2.
Figure 4:
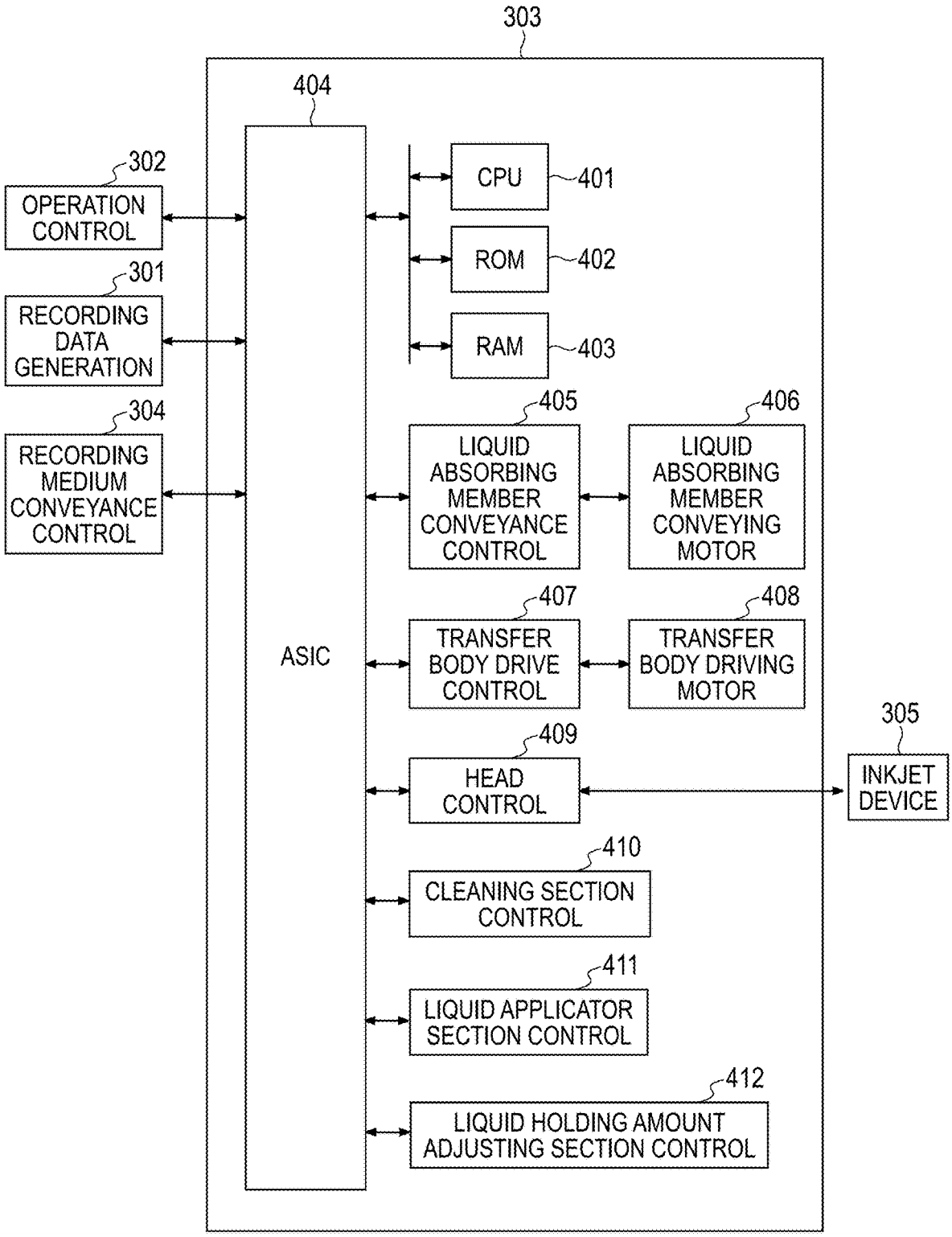
FIG. 4 is a block diagram of a printer control section in the transfer type inkjet recording apparatus illustrated in FIG. 1.

The transfer type inkjet recording apparatus according to this embodiment includes a control system that controls each device as an apparatus operation control section. FIG. 3 is a block diagram illustrating the control system of the entire device in the transfer type inkjet recording apparatus illustrated in FIG. 1. In FIG. 3, reference numeral 301 denotes a recording data generating section such as an external print server, reference numeral 302 denotes an operation control such an operation panel, reference numeral 303 denotes a printer control section to perform a recording process, reference numeral 304 denotes a recording medium conveyance control to convey the recording medium, and reference numeral 305 denotes an inkjet device to perform printing. FIG. 4 is a block diagram of the printer control section in the transfer type inkjet recording apparatus illustrated in FIG. 1. Reference numeral 401 denotes a CPU controlling the entire printer, reference numeral 402 denotes a ROM to store control programs of the CPU 401, and reference numeral 403 denotes a RAM to execute the programs. Reference numeral 404 denotes an integrated circuit (Application Specific Integrated Circuit: ASIC) for specific purposes incorporating a network controller, a serial IF controller, a head data creation controller, a motor controller, and a similar controller. Reference numeral 405 denotes a liquid absorbing member conveyance control to drive a liquid absorbing member conveying motor 406 controlled by a command from the ASIC 404 via the serial IF. Reference numeral 407 denotes a transfer body drive control to drive a transfer body driving motor 408 similarly controlled by a command from the ASIC 404 via the serial IF. Reference numeral 409 denotes a head control that, for example, creates final discharge data of the inkjet device 305 and generates a driving voltage. Reference numeral 410 denotes a cleaning section control. The cleaning section control 410 is usable as an elevation control section of the liquid absorbing member cleaning device to drive an air cylinder for elevation (not illustrated) of the liquid absorbing member cleaning device, namely, a liquid absorbing member cleaning control section. The cleaning section control 410 is controlled by a command from the ASIC 404 via the serial IF. Reference numeral 411 denotes a liquid applicator section control. The liquid applicator section control 411 is usable as an elevation control section of a recovery liquid applicator device to drive an air cylinder for elevation (not illustrated) of the recovery liquid applicator device, namely, a recovery liquid application control section. The liquid applicator section control 411 is controlled by a command from the ASIC 404 via the serial IF. Reference numeral 412 denotes a liquid holding amount adjusting section control. The liquid holding amount adjusting section control 412 is usable as an elevation control section of the liquid holding amount adjustment device to drive an air cylinder for elevation (not illustrated) of the liquid holding amount adjustment device, namely, a liquid holding amount adjustment control section. The liquid holding amount adjusting section control 412 is controlled by a command from the ASIC 404 via the serial IF.

<Evaluation of State of Porous Body and Processing of Porous Body>

The inkjet recording apparatus according to this embodiment includes a system that evaluates the state of gas permeability of the porous body repeatedly retransmitted to the liquid absorption treatment region by the liquid absorbing member conveying device. Using the evaluation system of the gas permeability state of this porous body, a gas permeability evaluating step that evaluates the state of gas permeability of the porous body from contact information of a liquid absorbing surface of the porous body provided with the liquid absorbing member to the image and a specific parameter regarding a gas permeability of the porous body is performed. The contact information used for this evaluation includes the number of contact times (the accumulated number of contact times from a start of the use of the identical porous body) to an image of the porous body repeatedly retransmitted to the liquid absorption treatment region and information on a contact pressure in each contact applied to the liquid absorbing surface of the porous body. A contact pressure of each member brought into contact with the porous body is used for the contact pressure applied to the porous body. For example, the contact pressure set to the pressing member 105*b* for the liquid absorbing member is usable. These contact pressures may be measured and grasped in advance, and when the inkjet recording apparatus adjusts the contact pressure of each member to the porous body, the CPU 401 can recognize the adjusted contact pressure and the ROM 402 can store the contact pressure for use. As the number of contact times, a value measured by a counter disposed at the liquid absorber device is usable. It is only necessary that the contact count counter can count the number of times of passing of the liquid absorption treatment region by the identical portion of the porous body and therefore is not especially limited. For example, an encoder that senses the rotation of the roller conveying the liquid absorbing member 105*a* is usable. Alternatively, the ASIC 404 may have a count function such that a count value of a register provided inside the ASIC is updated, or a count function may be achieved by the functions of the CPU 401 and the ROM 402. The contact information, which includes the contact pressure when the porous body is repeatedly used and the number of contact times, is stored in a contact information storing section to be used for the evaluation of the state of gas permeability of the porous body. The contact information storing section can be disposed, for example, in the RAM 402 illustrated in FIG. 4. Here, the inkjet recording apparatus performs various modes such as a startup sequence, a terminating sequence, a usual printing, and a maintenance. In each mode, the contact to the porous body is not always performed with the identical combination. For example, in the startup sequence of the inkjet recording apparatus, the transfer body 101 is not brought into contact with the liquid absorbing member 105*a* but the transfer body 101 is brought into contact with the liquid absorbing member 105*a* after the required startups are performed on each of the transfer body 101 side and the liquid absorber device 105 side. In the startup on the liquid absorber device 105 side as well, the liquid absorbing member cleaning member 110*a*, the pretreatment liquid applying member 111*b*, and the liquid holding amount adjusting member 112*b* are brought into contact in order. Among these members, some members are possibly brought into contact with the liquid absorbing member after the transfer body 101 is brought into contact with the liquid absorbing member 105*a*.

Although the transfer body 101 is brought into contact with the liquid absorbing member 105*a* in the ordinary printing, in the terminating sequence of the inkjet recording apparatus, after the transfer body 101 is separated from the liquid absorbing member 105*a*, the required termination is performed on each of the transfer body 101 side and the liquid absorber device 105 side. In consideration of these circumstances, the contact information storing section recognizes the mode in the inkjet recording apparatus and stores the contact information including the contact pressure and the number of contact times of one or the plurality of members brought into contact with the liquid absorbing member 105*a* in the mode or further in a phase of the mode. The gas permeability state evaluating section can compute a Gurley value as an index of the gas permeability using the contact information and the specific parameter and evaluate the state of gas permeability of the porous body using the Gurley value. The apparatus operation control section illustrated in FIG. 4 can perform a function of the gas permeability state evaluating section in the CPU 401 using an evaluation program mounted to the ROM 402. The gas permeability state evaluating section evaluates the state of gas permeability using the contact information for each mode or each phase stored in the contact information storing section. Disposing the porous body processing control section allows selecting and instructing a processing regarding the porous body to the corresponding device (not illustrated in FIG. 1 and FIG. 4) according to the state of gas permeability of the porous body evaluated by the gas permeability state evaluating section. This processing regarding the porous body can include the following processings:

(I) Notifying an exchange timing of the porous body; or (II) Suspending or terminating the image formation operation (the ink image forming operation)

The processing (I) can be performed using the operation control 302. The processing (II) can be performed by the apparatus operation control section illustrated in FIG. 3. The specific parameter is preliminary obtained and stored in, for example, the ROM 402. For example, it is preferred to use fitting coefficients by a polynomial with variables x and y where the number of contact times is x and the contact pressure is y with respect to gas permeability z evaluated by repeatedly applying the contact pressure to the porous body in advance.

Figure 11:
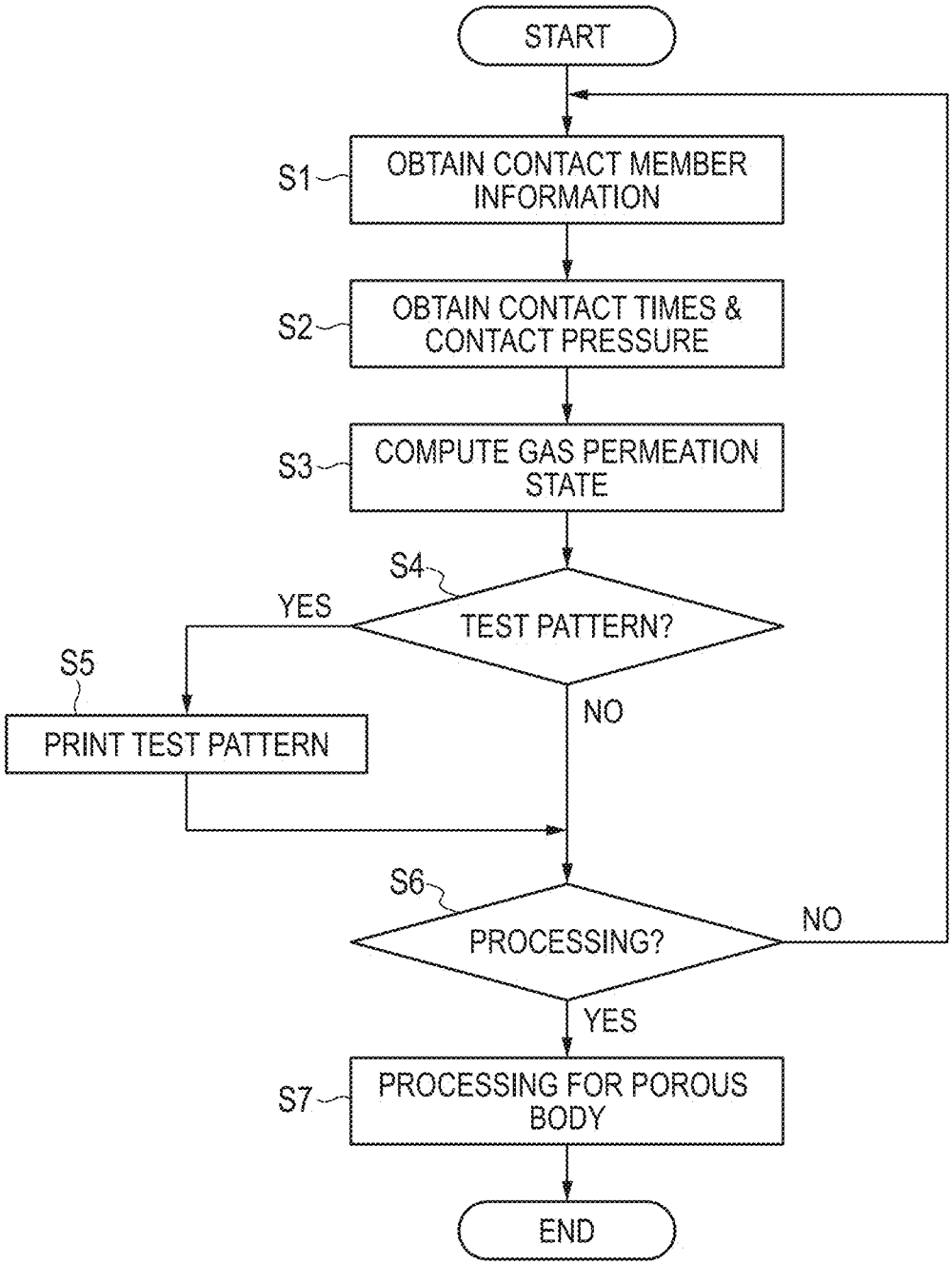
FIG. 11 is a flowchart of processes performed by the inkjet recording apparatus according to the one embodiment of the present invention.

Disposing an image quality detection device that detects the image quality of the image that has gone through the liquid absorbing treatment by the liquid absorber device and correcting the evaluation of the state of gas permeability of the porous body by the gas permeability state evaluating section allow further improvement of evaluation accuracy. In this case, a gas permeability state evaluating section has a correction function that corrects the evaluation of the state of gas permeability by the evaluation of the state of the porous body by a porous body state evaluating section. This correction of the evaluation can be performed by a step of evaluating the state of the porous body in which a test pattern for image quality check is formed as an image, the image quality of the test pattern that has gone through the liquid absorption step is detected by the image quality detection device, and the state of the porous body is evaluated by the obtained detection result. The evaluation of the state of gas permeability can be corrected based on the detection result by this image quality detection device. The porous body state evaluating section, which performs the above-described correction of the evaluation, can be constituted of the CPU 401, the ROM 402, and the RAM 403 illustrated in FIG. 4. In this porous body state evaluating section, the apparatus operation control section instructs the printer control section 303 to form the test pattern for image quality check. The apparatus operation control section instructs the image quality detection device to detect the image quality of the test pattern formed on the transfer body 101 and has gone through the liquid absorbing treatment by the liquid absorber device. The state of the porous body is evaluated by the detection result obtained by the image quality detection device. The image quality detection device includes a reading section that optically reads the test pattern. The reading section is disposed between the liquid absorber device and the transfer section to ensure reading the test pattern on the transfer body 101. The image data of the read pattern is transmitted to the RAM 403 and is used as information by the porous body state evaluating section. The image quality detection device may be disposed such that the pattern is printed to the recording medium through the transfer section and the pattern is read at a conveyance path of the recording medium after the transfer section. The user sees the printed pattern and may input the information used by the porous body state evaluating section via the operation control 302. A porous body state evaluating section evaluates the Gurley value of the porous body from the obtained information. The Gurley value computed by the gas permeability state evaluating section and stored in the ROM 402 is corrected. For example, when a value found by subtracting the Gurley value computed by the gas permeability state evaluating section from the Gurley value obtained from the information obtained by the porous body state evaluating section is equal to or more than a predetermined value, the Gurley value can be updated to the Gurley value obtained by the porous body state evaluating section. Meanwhile, the porous body may be configured to be replaceable, parameter information specific to the porous body may be attached to each porous body for exchange, the parameter information specific to the porous body stored in the contact information storing section may be input from an input section, and the parameter information may be updated every time the porous body is exchanged. The device may be configured such that this parameter can be input manually or automatically. The reading method in the automatic input, that is, the information for reading and the configuration of the reading section are not specifically limited, and the known system is usable. FIG. 11 illustrates one example of a flow for the state evaluation of the gas permeability of the inkjet recording apparatus described above. First, when the flow starts, contact member information is obtained at Step S1. This information is information to identify which contact member is brought into contact with the liquid absorbing member 105*a*. The CPU 401 determines the mode in execution or the phase of the mode to identify the contact member. Next, at Step S2, the number of contact times for the one or the plurality of contact members identified at Step S1 is counted and stored in the contact information storing section together with the contact pressure. The number of contact times is counted for a predetermined period, and the number of contact times is read from the contact information storing section to obtain the number of contact times. At Step S3, the gas permeability state evaluating section computes the Gurley value. At the subsequent Step S4, whether to perform the test pattern printing or not is determined based on the result of Step S3. When the Gurley value computed by the gas permeability state evaluating section is larger than a predetermined value, the test pattern is printed at Step S5 and the process proceeds to Step S6. The porous body state evaluating section evaluates whether a processing regarding the porous body is required or not based on the input related to the test pattern at Step S5. When the process becomes necessary at Step S6, the porous body processing control section performs the processing regarding the porous body at Step S7. When the Gurley value is not larger than the predetermined value at Step S4, the process proceeds to Step S6, and the porous body state evaluating section evaluates whether the processing regarding the porous body is required or not. The porous body state evaluating section basically evaluates that the processing is unnecessary and the process returns to Step S1. When the evaluation result is NO at Step S4, the process may return to Step S1 without through Step S6.

(Direct Drawing Type Inkjet Recording Apparatus)

Figure 2:
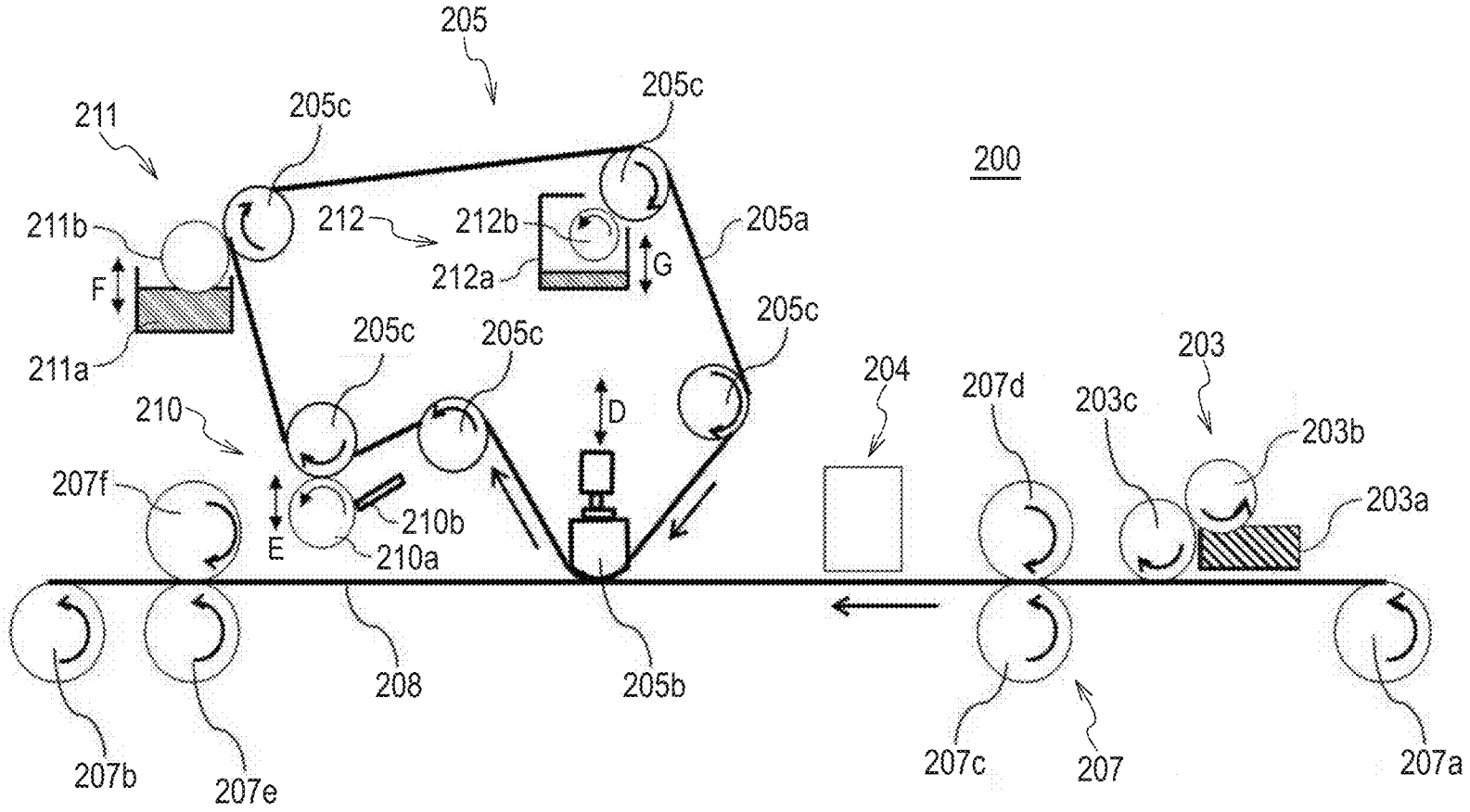
FIG. 2 is a schematic diagram illustrating one example of a configuration of a direct drawing type inkjet recording apparatus according to one embodiment of the present invention.

Another embodiment according to this embodiment includes the direct drawing type inkjet recording apparatus. In the direct drawing type inkjet recording apparatus, the ejection target medium is a recording medium to form the image. FIG. 2 is a schematic diagram illustrating one example of a schematic configuration of a direct drawing type inkjet recording apparatus 200 according to this embodiment. Compared with the above-described transfer type inkjet recording apparatus, the direct drawing type inkjet recording apparatus includes means similar to those of the transfer type inkjet recording apparatus except that the direct drawing type inkjet recording apparatus does not include the transfer body 101, the supporting member 102, and the transfer body cleaning member 109 and forms an image on a recording medium 208. Accordingly, since a reaction liquid applicator device 203, which includes a reaction liquid container 203*a* and reaction liquid applying members 203*b* and 203*c*, and an ink applicator device 204 have configurations similar to those of the transfer type inkjet recording apparatus, the explanation of these members is omitted. Further, an explanation of a liquid absorber device 205 that absorbs the liquid component contained in the ink image by a liquid absorbing member 205*a* in contact with the ink image on the recording medium 208 is also similarly omitted. An explanation of a liquid absorbing member cleaning device 210 that includes a liquid absorbing member cleaning member 210*a* to remove an attachment from the liquid absorbing member 205*a* and a cleaning blade 210*b* is also similarly omitted. Explanations of a pretreatment liquid applicator device 211 that includes a pretreatment liquid container 211*a* and a pretreatment liquid applying member 211*b* and applies the pretreatment liquid to the liquid absorbing member 205*a* and a liquid holding amount adjustment device 212 that includes a liquid holding amount adjusting member 212*b* and an excess liquid container 212*a* and removes unnecessary liquid from the liquid absorbing member 205*a* to adjust the liquid holding amount are also similarly omitted. Note that, with the direct drawing type inkjet recording apparatus of this embodiment, the liquid absorber device 205 includes the liquid absorbing member 205*a* and a pressing member 205*b* for liquid absorption that presses the liquid absorbing member 205*a* against the ink image on the recording medium 208. Shapes of the liquid absorbing member 205*a* and the pressing member 205*b* are not specifically limited, and shapes similar to those of the liquid absorbing member and the pressing member usable in the transfer type inkjet recording apparatus are usable. The liquid absorber device 205 may include a stretching member stretching the liquid absorbing member. In FIG. 2, reference numeral 205*c* denotes stretching rollers used as stretching members. A count of the stretching rollers is not limited to five of the stretching rollers of FIG. 2, and it is only necessary that the count of required stretching rollers be arranged according to the device design. There may be an ink application section that applies the ink over the recording medium 208 by the ink applicator device 204, and a recording medium supporting member (not illustrated) that supports the recording medium from the lower side disposed at a liquid component removal section that brings the liquid absorbing member 205*a* in contact with the ink image on the recording medium to remove the liquid component.

<Recording Medium Conveyer Device>

A recording medium conveyer device 207 of the direct drawing type inkjet recording apparatus according to this embodiment is not especially limited and the known conveyance means in the direct drawing type inkjet recording apparatus is usable. As illustrated in FIG. 2, an example of the recording medium conveyer device 207 includes a recording medium conveyer device that includes a recording medium feeding roller 207*a*, a recording medium winding roller 207*b*, recording medium conveyance rollers 207*c*, 207*d*, 207*e*, and 207*f*.

<Control System>

Figure 5:
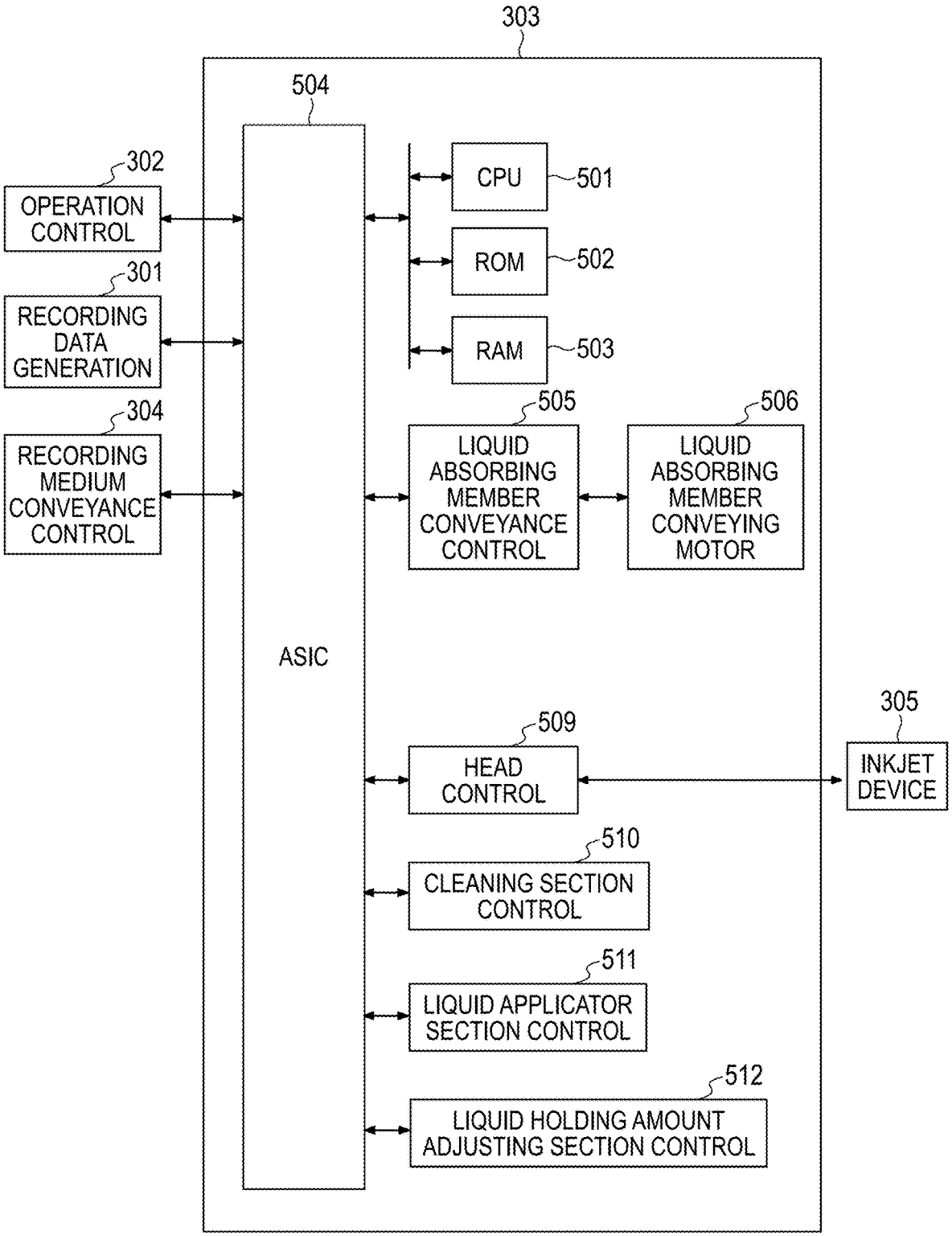
FIG. 5 is a block diagram of a printer control section in the direct drawing type inkjet recording apparatus illustrated in FIG. 2.

The direct drawing type inkjet recording apparatus according to this embodiment includes a control system that controls each device. A block diagram illustrating the control system of the entire device in the direct drawing type inkjet recording apparatus illustrated in FIG. 2 is as illustrated in FIG. 3 similar to the transfer type inkjet recording apparatus illustrated in FIG. 1. FIG. 5 is a block diagram of a printer control section in the direct drawing type inkjet recording apparatus of FIG. 2. Except for not including the transfer body drive control 407 and the transfer body driving motor 408, the printer control section is similar to the block diagram of the printer control section in the transfer type inkjet recording apparatus of FIG. 4. That is, reference numeral 501 denotes a CPU controlling the entire printer, reference numeral 502 denotes a ROM to store control programs of the CPU, and reference numeral 503 denotes a RAM to execute the programs. Reference numeral 504 denotes an ASIC incorporating a network controller, a serial IF controller, a head data creation controller, a motor controller, and a similar controller. Reference numeral 505 denotes a liquid absorbing member conveyance control to drive a liquid absorbing member conveying motor 506 controlled by a command from the ASIC 504 via the serial IF. Reference numeral 509 denotes a head control that, for example, creates final discharge data of the inkjet device 305 and generates a driving voltage. Reference numeral 510 denotes a cleaning section control. The cleaning section control 510 is usable as an elevation control section of the liquid absorbing member cleaning device to drive an air cylinder for elevation (not illustrated) of the liquid absorbing member cleaning device, namely, a liquid absorbing member cleaning control section. The cleaning section control 510 is controlled by a command from the ASIC 504 via the serial IF. Reference numeral 511 denotes a liquid applicator section control. The liquid applicator section control 511 is usable as an elevation control section of a recovery liquid applicator device to drive an air cylinder for elevation (not illustrated) of the recovery liquid applicator device, namely, a recovery liquid application control section. The liquid applicator section control 511 is controlled by a command from the ASIC 504 via the serial IF. Reference numeral 512 denotes a liquid holding amount adjusting section control. The liquid holding amount adjusting section control 512 is usable as an elevation control section of the liquid holding amount adjustment device to drive an air cylinder for elevation (not illustrated) of the liquid holding amount adjustment device, namely, a liquid holding amount adjustment control section. The liquid holding amount adjusting section control 512 is controlled by a command from the ASIC 504 via the serial IF.

<Change in Property of Liquid Absorbing Member by Contact Pressure>

Figure 6:
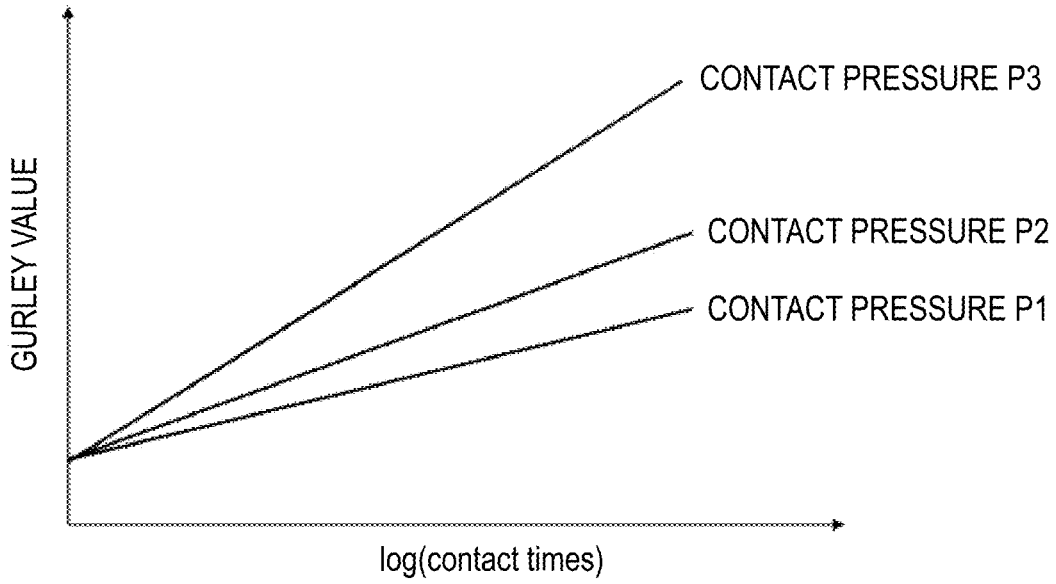
FIG. 6 is a relationship diagram between the number of contact times and a Gurley value when a contact pressure is applied to a porous body.

Applying the contact pressure to the liquid absorbing member constituted of the porous body exhibits a compression deformation according to the contact pressure. While releasing the contact pressure recovers the state to the state before the contact from the deformation, repeatedly keeping applying the contact pressure leaves a permanent set, deteriorating the gas permeability of the porous body. FIG. 6 illustrates a relationship diagram between the contact pressure, the number of contact times, and the Gurley value of the porous body, which serves as the index of the gas permeability, when the contact pressure is repeatedly applied to the porous body. It has been found that the change in the Gurley value with respect to a logarithm of the number of contact times indicates a linear relationship, and the higher the contact pressure is, the larger an increase rate of the Gurley value (P1<P2<P3). Defining the number of contact times as x, the contact pressure as y, and the Gurley value of the porous body as z, the contact pressure, the number of contact times, and the Gurley value can be expressed by the following relational expression.

$$z=a\cdot\log(x)+b\cdot y+c\ \log(x)\cdot y+d: \qquad \text{Expression (1)}$$

Here, a, b, c, and d are coefficients and are specific parameters for each porous body. The specific parameters can be determined by fitting the change in Gurley value when the porous body is repeatedly brought into contact at different contact pressures in advance using Expression (1). As long as the above-described specific parameters and the contact pressure applied while the liquid absorbing member 105*a* rotates by one are found, an amount of increase in the Gurley value by the contact can be computed. The Gurley value of the porous body of the liquid absorbing member 105*a* at a certain time point t is defined as z(t). Defining a contact pressure applied to the liquid absorbing member by the pressing member 105*b* for the liquid absorbing member as $P_A$ and a contact pressure by the treatment liquid applicator device 10 as $P_B$, the Gurley value z (t+1) after the liquid absorbing member 105*a* rotates by one is:

$$\begin{aligned} z(t+1) = & \qquad \text{Expression (2)} \\ & z(t)+a\cdot\log(x_A(t+1))+b\cdot P_A+c\log(x_A(t+1))\cdot P_A+ \\ & d-(a\cdot\log(x_A(t))+b\cdot P_A+c\log(x_A(t))\cdot P_A+d)+ \\ & a\cdot\log(x_B(t+1))+b\cdot P_B+c\log(x_B(t+1))\cdot P_B+d- \\ & (a\cdot\log(x_B(t))+b\cdot P_A+c\log(x_B(t))\cdot P_B+d)=z(t) \\ & +(a+c\cdot P_A)\cdot\log(x_A(t+1)/x_A(t))+ \\ & (a+c\cdot P_B)\cdot\log(x_B(t+1)/x_B(t))=z(t) \\ & +(a+c\cdot P_A)\cdot\log((x_A(t)+1)/x_A(t))+ \\ & (a+c\cdot P_B)\cdot\log((x_B(t)+1)/x_B(t)). \end{aligned}$$

Here, from Expression (1), $x_A(t)$ and $x_B(t)$ are:

$$x_A(t)=10\hat{}\{(z(t)-b\cdot P_A-d)/(a+c\cdot P_A)\} \qquad \text{Expression (3A)}$$

$$x_B(t)=10\hat{}\{(z(t)-b\cdot P_B-d)/(a+c\cdot P_B)\} \qquad \text{Expression (3B).}$$

The above-described gas permeability state evaluating section can use the relational expressions described above and predict the Gurley value of the porous body by the computation using the contact pressure and the number of contact times received by the liquid absorbing member 105*a* stored in the contact information storing section and Expression (2). This prediction is used for the processing of the liquid absorbing member in the inkjet recording apparatus as the gas permeability index of the porous body. Here, while the explanation is given with a configuration having the contact parts at two sites, in the case where a cleaning mechanism, a liquid holding amount adjustment mechanism, or a similar mechanism is additionally provided using a contact member as well, the use of the above-described relational expressions similarly ensures the prediction of the Gurley value of the porous body.

<Image Smearing>

Figure 7:
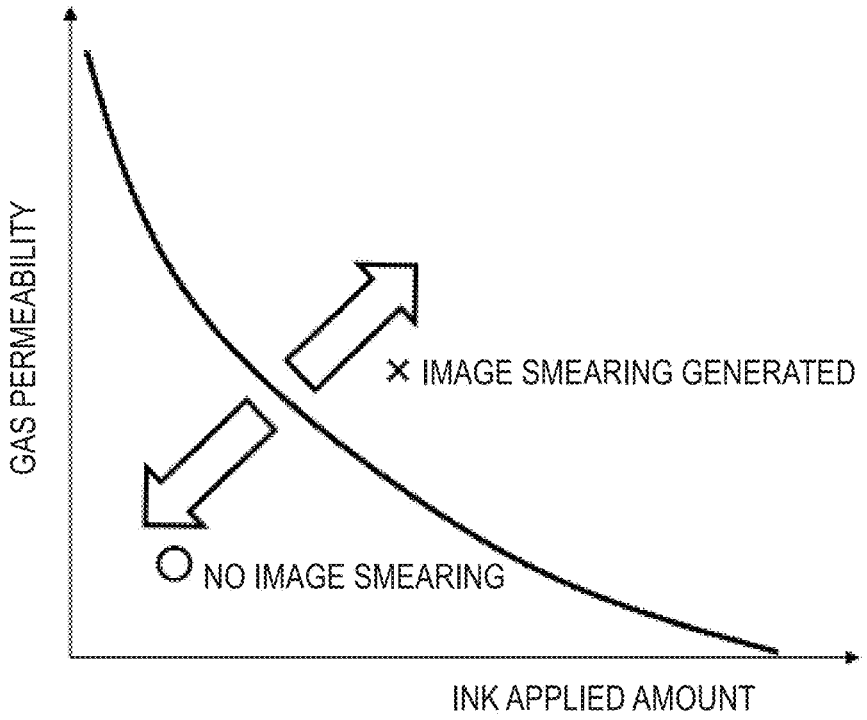
FIG. 7 is a relationship diagram between an ink applied amount and gas permeability of the porous body regarding image smearing.
Figure 8A:
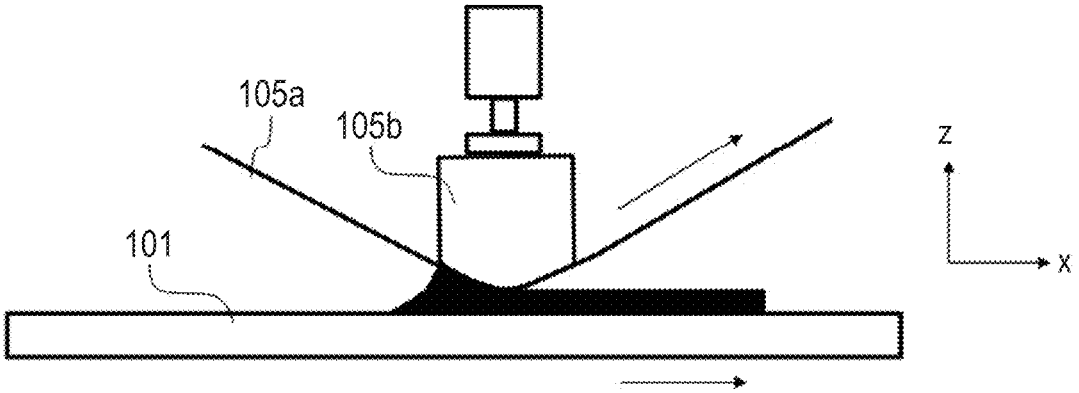
FIG. 8A and FIG. 8B are schematic diagrams of image smearing.
Figure 8B:
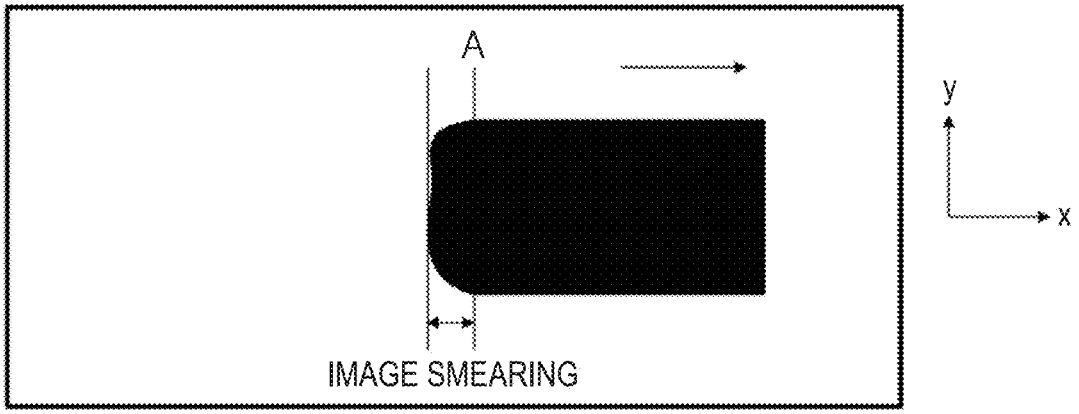

FIG. 7 illustrates the relationship between an ink applied amount and the gas permeability of the porous body in image smearing. When the liquid absorbing member removes the liquid from the ink image, image smearing is likely to occur as the gas permeability of the porous body becomes low. Image smearing is likely to occur as the ink applied amount of the image becomes large. The liquid absorbing step is established by a balance between an action of pressing and flowing the ink image by the contact pressure at the liquid absorbing member and the liquid being absorbed to increase the viscosity of the ink so as to cause the deformation of the image to be less likely to occur. Accordingly, image smearing occurs related to the gas permeability of the porous body and the ink applied amount of the image. FIG. 8A and FIG. 8B are schematic diagrams when image smearing occurs. If an absorption speed of the liquid at the liquid absorbing member 105*a* is slow or the ink applied amount is large, the ink image (the black part) on the transfer body 101 is pressed and flown to the upstream in the conveyance direction of the transfer body 101, thus disturbing the image. Although image smearing is easily confirmed at an end portion of a solid image, when the movement occurs similarly at the inside of the image except for the end portion and the amount of movement by image smearing occurs by around 20 μm or more, which is a limit of visual confirmation by a human, a problem of image quality deterioration becomes remarkable further. Although image smearing is caused by a loss of balance between the liquid absorption property of the porous body and a resistive power to an external force determined by a cohesive force of the ink image, a threshold whether image smearing occurs or not is changed by various conditions. For example, with the fast conveyance velocity of the transfer body 101, a temporal change of a pressure profile of a nip portion of the liquid absorbing member 105*a* with the transfer body becomes large, and the image is pressed and flown before the liquid is sufficiently absorbed. Additionally, when the pressing force by the pressing member 105*b* to a liquid absorbing portion to the transfer body is large, the temporal change of the pressure profile becomes large similarly, and image smearing is likely to occur. Besides, since material plasticity constituting the ink and the reaction liquid, the ink temperature during the liquid absorption, and the like also change the cohesive force of the ink, an extent of causing image smearing changes. The ink image illustrated in FIG. 8B is usable as the test pattern. A line A in the drawing is a position of a left end of an ink image before in contact with the liquid absorbing member 105*a*. A length (illustrated in the drawing by the arrow) from this position to the left end of the ink image after in contact with the liquid absorbing member 105*a* differs depending on the extent of image smearing. Accordingly, as long as the change in the position of the upstream-side end portion of the test pattern before and after in contact with the liquid absorbing member 105*a* in the moving direction of the liquid absorbing member 105*a* can be recognized, image smearing can be evaluated using the test pattern. The position of the upstream-side end portion of the test pattern in the moving direction of the liquid absorbing member 105*a* is recognized, and the Gurley value can be obtained from a distance between the recognized position and a reference. The reference position may be a right end (a position of the downstream-side end portion in the moving direction of the liquid absorbing member 105*a*) of the ink image before or after in contact with the liquid absorbing member 105*a* or the position A in the drawing. To read the ink image by the image quality detection device, analysis of the obtained image data facilitates the recognition of the reference position A. In the light of the above-described state, the threshold at which image smearing occurs is grasped in advance under a condition of operating the device, and the gas permeability of the porous body predicted in the present invention is compared with the threshold at which image smearing occurs, thereby ensuring appropriately handling the situation before image smearing occurs.

WORKING EXAMPLES

The following describes this embodiment in further detail using working examples and comparative examples. As long as within the gist of the present invention, the present invention is not limited by the following working examples by any means. Unless otherwise stated, a "pts.wt." means a mass criterion in the following description of the working examples.

Working Example 1

This working example used the transfer type inkjet recording apparatus illustrated in FIG. 1. The transfer body 101 of this working example is fixed to the supporting member 102 with adhesive. This working example used a sheet produced by coating silicone rubber (trade name: KE12 manufactured by Shin-Etsu Chemical) with a thickness of 0.3 mm on a PET sheet with a thickness of 0.5 mm as an elastic layer of the transfer body. As a heat-insulating layer for the supporting member 102 and this elastic body, foaming silicone rubber containing air bubbles with the thickness of 0.5 mm was used as the lower layer of the elastic layer. Further, glycidoxypropyl triethoxysilane and methyltriethoxysilane were mixed at a mole ratio of 1:1 to manufacture a mixture of a condensate obtained by heating and reflux and a photo-cationic polymerization initiator (trade name: SP150 manufactured by ADEKA). An atmospheric-pressure plasma treatment was performed such that a contact angle of the surface of the elastic layer with respect to the water became 10 degrees or less, the mixture was applied over the elastic layer to form a film by UV irradiation (high-pressure mercury lamp, integrated exposure amount: 5000 mJ/cm$^2$) and heat hardening (at 150° C. for two hours), thus manufacturing the transfer body 101 where a surface layer with the thickness of 0.5 μm was formed on the elastic body. Although the illustration of this configuration is omitted for simplification of the explanation, a double-sided adhesive tape was used between the transfer body 101 and the supporting member 102 to hold the transfer body 101. The double-sided adhesive tape was also used between the elastic layer of the transfer body 101 and the heat-insulating layer to hold the elastic layer. Reaction liquid applied by the reaction liquid applicator device 103 with the following composition was used, and the amount of application was set to 1 g/m$^2$.

Levulinic acid: 40.0 pts.wt.
Glycerin: 5.0 pts.wt.
Megaface F444 (trade name): 1.0 pts.wt. (surfactant manufactured by DIC)
Ion exchanged water: 54.0 pts.wt.

The ink was prepared as follows.

<Preparation of Resin Particles>

Butyl methacrylate of 18.0 pts.wt, a polymerization initiator (2,2'-azobis(2-methylbutyronitrile)) of 2.0 pts.wt., and n-hexadecane of 2.0 pts.wt. were put in a four-necked flask including a stirrer, a reflux cooling device, and a nitrogen gas introduction tube, nitrogen gas was introduced as a reaction system, and the product was stirred for 0.5 hours. Water solution with 6.0% of emulsifier (trade name: NIKKOL BC15 manufactured by Nikko Chemicals) was dropped by 78.0 pts.wt. in this flask, and the product was stirred for 0.5 hours. Next, ultrasonic sound wave was irradiated for three hours by an ultrasonic wave irradiation device to emulsify the mixture. Afterwards, a polymerization reaction was performed at 80° C. for four hours under nitrogen atmosphere. After the reaction system was cooled down to 25° C., the component was filtered, and pure water was added by an appropriate amount, thus preparing aqueous dispersion of resin particles 1 with a content of the resin particles 1 (a solid content) of 20.0%.

<Preparation of Resin Water Solution>

Styrene-ethyl acrylate-acrylic acid copolymer (resin 1) with an acid value of 150 mgKOH/g and a weight average molecular weight of 8,000 was prepared. The resin 1 of 20.0 pts.wt. was neutralized by potassium hydroxide with a mole equal to that of the acid value, and pure water was added by an appropriate amount, thus preparing water solution of the resin 1 with the content of the resin (the solid content) of 20.0%.

<Preparation of Ink>

(Preparation of Pigment Dispersion Liquid)

Pigment (carbon black) of 10.0 pts.wt., the water solution of the resin 1 of 15.0 pts.wt., and the pure water of 75.0 pts.wt. were mixed. This mixture and zirconia beads with a diameter of 0.3 mm of 200 pts.wt. were put in a batch-type vertical sand mill (manufactured by Aimex) and dispersed for five hours while being water cooled. Afterwards, centrifugation was performed to remove coarse particles, and the product was pressurized and filtered with a cellulose acetate filter (manufactured by Advantec) with a pore size of 3.0 μm, thus preparing pigment dispersion liquid K with a content of the pigment of 10.0% and a content of the resin dispersing agent (resin 1) of 3.0%.

(Preparation of Ink)

Respective components described below were mixed and sufficiently stirred, and then the product was pressurized and filtered with the cellulose acetate filter (manufactured by Advantec) with the pore size of 3.0 μm, thus preparing each ink. Acetylenol E100 is surfactant manufactured by Kawaken Fine Chemicals.

(Composition of Ink)

Pigment dispersion liquid K: 20.0 mass %
Aqueous dispersion of resin particles 1: 50.0 mass %
Water solution of resin 1: 5.0 mass %
Glycerin: 5.0 mass %
Diethylene glycol: 7.0 mass %
Acetylenol E100: 0.5 mass %
Pure water: 12.5 mass %

As the ink applicator device 104, an inkjet device including an inkjet head of a type performing an ink discharge by an on-demand method using an electro-thermal conversion element was used, and the ink applied amount was set to 20 g/m$^2$.

<Liquid Absorbing Member>

Figure 9:
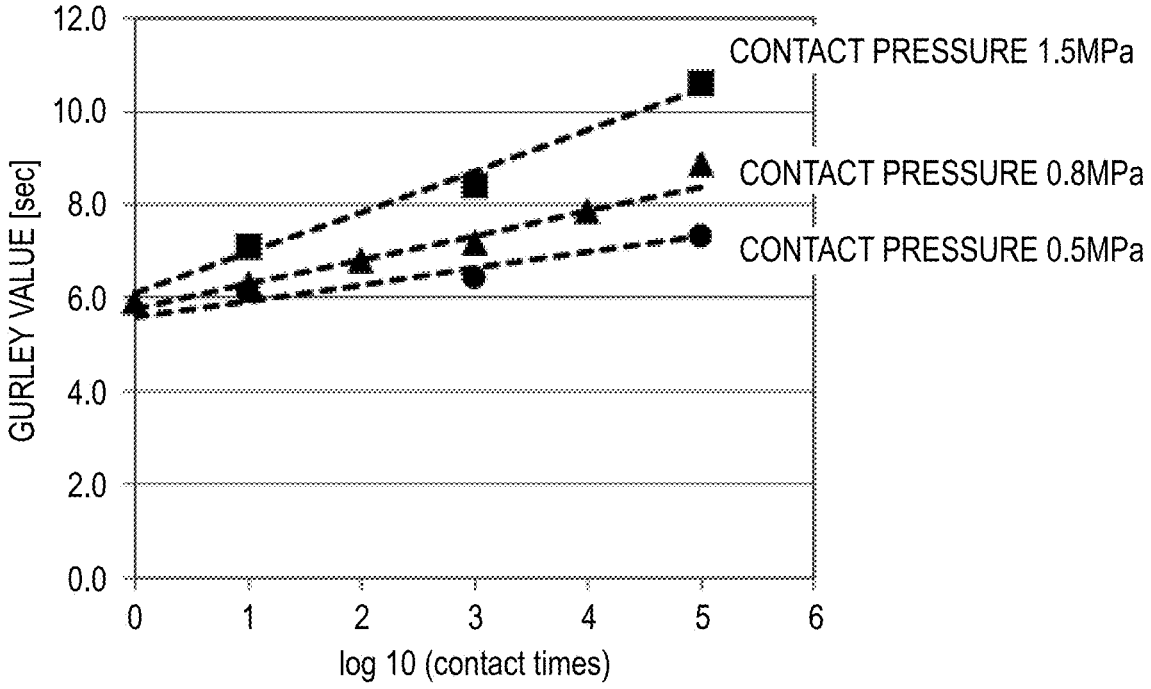
FIG. 9 is a relationship diagram between the number of contact times and the Gurley value when the contact pressure is applied to the porous body.
Figure 10:
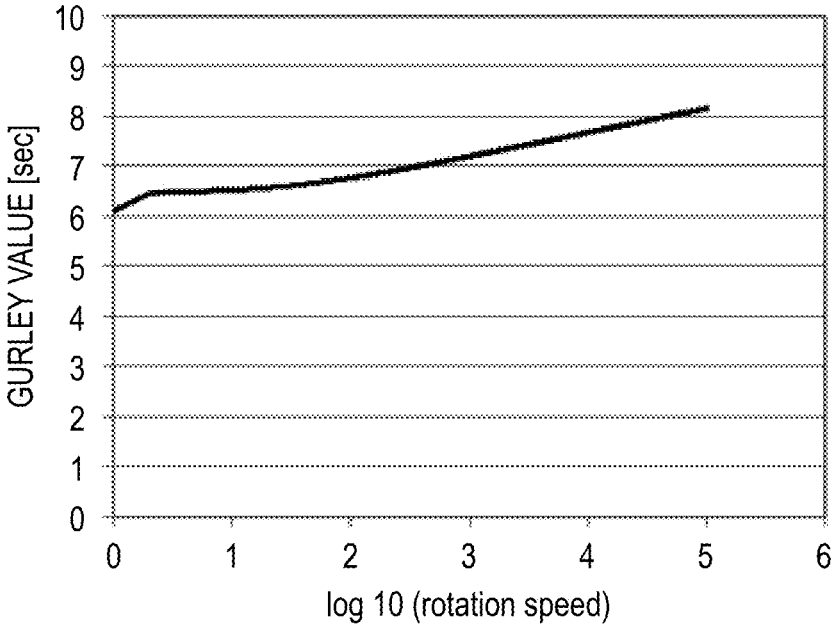
FIG. 10 is a relationship diagram between a rotation speed of the porous body and the Gurley value of Working Example 1.

The liquid absorbing member in which the porous bodies were stacked by three layers was used. A porous PTFE with an average hole diameter of 0.3 μm was used as a first layer on the side in contact with the ink image. A porous film made of polyolefin was used as a first support layer. A porous film made of polyphenyl sulfide was used as a second support layer. These layers were stacked by heat lamination for use as the liquid absorbing member. This liquid absorbing member was immersed into a processing liquid constituted of ethanol of 95 pts.wt. and water of 5 pts.wt. and was penetrated, and then the liquid was substituted by liquid constituted of water of 100 pts.wt., and subsequently the liquid absorbing member was used to remove the liquid. As the pressing member 105*b* in liquid absorption means, one with a roller diameter of φ200 mm was used. The liquid absorbing member 105*a* was adjusted so as to have a speed equivalent to the moving speed of the transfer body 101 by conveyance rollers 105*c*, 105*d*, and 105*e*, which stretch and convey the liquid absorbing member. The recording medium 108 is conveyed by the recording medium feeding roller 107*a* and the recording medium winding roller 107*b* so as to have a speed equivalent to the moving speed of the transfer body 101. This working example set the conveyance velocity to 0.6 m/s, and used an Aurola Coat paper (trade name manufactured by Nippon Paper Industries, basis weight of 104 g/m$^2$) as the recording medium 108. FIG. 9 illustrates measurement results (measured values indicated by positions of each symbol ■, ▲, and •) of the Gurley value when a pressure was repeatedly applied to the porous body of the liquid absorbing member 105*a* used in this working example and fitting curves (dashed lines) by Expression (1). The contact pressure is three levels, which are 0.5 MPa, 0.8 MPa, and 1.5 MPa, and the state of change in the Gurley value until the number of contact times reaches to 10000 times is indicated. The specific parameters of the porous body determined by the fitting using Expression (1) were a=0.060, b=0.512, c=0.575, and d=5.35. The nip contact pressure between the transfer body 101 and the liquid absorbing member 105*a* is 0.75 MPa. The nip contact pressure between the liquid absorbing member cleaning member 110*a* and the liquid absorbing member 105*a* is 0.15 MPa. In the pretreatment device 111, the contact pressure of 0.15 MPa is applied between the offset roller 111*b* and the liquid absorbing member 105*a*. The nip contact pressure between the liquid holding amount adjusting member 112*b* and the liquid absorbing member 105*a* is 0.45 MPa. FIG. 10 illustrates the change in Gurley value computed considering the specific parameters a, b, c, and d of the porous body, the contact pressure, and the number of contact times under the above-described conditions. The horizontal axis indicates the number of times of rotations of the liquid absorbing member 105*a*. It has been found that although the initial Gurley value of the liquid absorbing member 105*a* is 5.2 secs, the contacts of the liquid absorbing member 105*a* with the liquid absorbing member cleaning member 110*a*, the offset roller 111*b*, and the liquid holding amount adjusting member 112*b* increase the Gurley value up to around 8.1 secs after the rotation of 100000 times. Meanwhile, it has been found from another preliminary examination that, in the configuration of the combination of the liquid absorbing member, the ink, and the like used in this working example, image smearing starts to appear to the extent that can be visually confirmed around when the Gurley value of the liquid absorbing member 105*a* exceeds 8 secs. Accordingly, in this working example, the Gurley value of the liquid absorbing member 105*a* needs to be 8 secs or less to effectively prevent image smearing. In this working example, setting a Gurley prediction value of 7.5 secs as the threshold and issuing a sign prompting the user to exchange the liquid absorbing member 105*a* when the Gurley value exceeds this threshold allow forestalling image smearing. The sign is issued to the user by lighting up a lamp for notification (not illustrated) mounted to the inkjet recording apparatus. The method for notification may be a method of displaying a notification on a provided LCD monitor for notification, in addition to the notification lamp. A count of sheets until exceeding seven seconds predicted from the Gurley value prediction is displayed, and the user is prompted to exchange the liquid absorbing member before image smearing occurs. Besides, the printing operation may be stopped to prevent printing of an image of poor image quality, and an exchange timing may be notified using, for example, the operation control.

Working Example 2

The basic configuration and operation of this working example are identical to those of Working Example 1. The liquid absorbing member 105*a* is replaceable and the specific parameter to predict the Gurley value is attached to the liquid absorbing member. The method for attachment may be a description on a storage container housing the liquid absorbing member or may be a directly description on the liquid absorbing member. When the liquid absorbing member is exchanged for new one, the specific parameter is input to the apparatus main body and the contact information until then is reset.

Working Example 3

The basic configuration and operation of this working example are identical to those of Working Example 1. In addition to the method for predicting the gas permeability from the contact information described in Working Example 1, a method for printing a check pattern can forestall the image quality deterioration caused by image smearing. With the configuration of this working example, image smearing occurred when the Gurley value of the porous body exceeded 8 secs with the condition of the ink applied amount being 20 g/m$^2$. It has been found that image smearing occurs when the Gurley value of the porous body exceeds 7.5 secs with the condition of the ink applied amount being 25 g/m$^2$. From these relationships, a test pattern for image quality check is printed with the ink applied amount of 25 g/m$^2$ at a startup of the apparatus and predetermined timings of the meantime of the printing, and image smearing after the liquid absorption step by the liquid absorbing member is gone through is evaluated. This test pattern has an image pattern by which whether the image smearing has occurred or not can be checked. When image smearing occurs, the notification lamp for the liquid absorbing member is lit up. Thus outputting the sign prompting the user to exchange the liquid absorbing member allows forestalling image smearing. An image sensor evaluates image smearing, and the presence/absence of image smearing is determined through a comparison of the input image data with the actually printed ink image. The transfer type inkjet recording apparatus, which forms the image on the transfer body and then goes through the liquid removal step and the transfer step to the recording medium, may perform the determination on the transfer body after the liquid removal step or on the image after being transferred to the recording medium. The direct drawing type inkjet recording apparatus, which does not use the transfer body, may perform the determination on the recording medium on which the image has been formed. Further, instead of using the image sensor, evaluation by visual confirmation by an operator is also possible.

Working Example 4

The basic configuration and operation of this working example are identical to those of Working Example 3. The use of the method for predicting the gas permeability from the contact information described in Working Example 1 and the method for printing the test pattern for image quality check described in Working Example 3 in combination can correct the predicted value of the gas permeability caused by an unanticipated situation, that is, correct the evaluation of the state of gas permeability of the porous body and forestall the image quality deterioration due to image smearing. There may be a case where the Gurley value becomes higher than the predicted value when the contact pressure to the liquid absorbing member becomes higher than the setting and by various conditions such as an attachment of a foreign matter to the porous body. Therefore, at the point when the Gurley value predicted from the contact information exceeds 7 secs, check patterns including regions with the ink applied amount of 20 $g/m^2$ and 25 $g/m^2$ are printed and evaluated for the state of image smearing by the image sensor. The image sensor may perform the evaluation on the transfer body or on the recording medium as described in Working Example 3. When image smearing occurs at the ink applied amount of 25 $g/m^2$, this suggests that the actual Gurley value is higher than the predicted value by 0.5 secs. When the Gurley value is determined to be higher than the predicted value by 0.5 secs, the current Gurley value is corrected to 7.5 sec. Then, the printing is continuously performed. When image smearing occurs at the ink applied amount of 20 $g/m^2$, the actual Gurley value is 8.0 secs, and this suggests that the Gurley value is higher than the predicted value by 1 sec. When the Gurley value is determined to be higher than the predicted value by 1 sec, this suggests that a possibility of causing image smearing is high; therefore, the printing behavior is stopped and the user is prompted to exchange the liquid absorbing member. These operations allow forestalling image smearing and forestalling the printing of a defective image where image smearing occurs.

The present invention can provide an inkjet recording method and an apparatus configured to evaluate a change in a state of a porous body and perform an appropriate processing according to the state of the porous body even when the porous body is repeatedly used to absorb a liquid ingredient from an image formed by an ink and a reaction liquid for increasing a viscosity of the ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131559, filed Jul. 4, 2017, which is hereby incorporated by reference herein in its entirety.

What is claimed is:

1. An inkjet recording method comprising:

an ink image forming step of applying an ink and a reaction liquid for increasing a viscosity of the ink to an ejection target medium to form an ink image on the ejection target medium, the ink containing an aqueous liquid component and a coloring material and being discharged by an inkjet method, the ink image containing the aqueous liquid component and the coloring material; and a liquid absorbing step of bringing a liquid absorbing surface of a porous body into contact with the ink image formed on the ejection target medium to absorb at least a part of the aqueous liquid component from the ink image by the porous body, the porous body being used in the liquid absorbing step repeatedly, the method further comprising:

a contact information storing step of storing contact information in an information storage medium, the contact information including the number of contact times to an ink image of the liquid absorbing surface of the porous body used in the liquid absorbing step and a contact pressure applied to the liquid absorbing surface of the porous body in each contact; and a gas permeability evaluating step of evaluating a state of gas permeability of the porous body based on the contact information and a specific parameter regarding a gas permeability of the porous body.

2. The inkjet recording method according to claim 1, further comprising a porous body processing step of performing a processing regarding the porous body according to the state of gas permeability of the porous body evaluated by the gas permeability evaluating step.

3. The inkjet recording method according to claim 2, wherein the processing regarding the porous body is to notify an exchange timing of the porous body.

4. The inkjet recording method according to claim 2, wherein the processing regarding the porous body is to stop an operation of image formation.

5. The inkjet recording method according to claim 1, wherein the specific parameter is a coefficient of each term of a polynomial when fitting to the polynomial of the number of contact times x and the contact pressure y as variables relative to a gas permeability z which is evaluated through repeated application of a contact pressure to the porous body in advance.

6. The inkjet recording method according to claim 1, further comprising a porous body evaluating step including forming a test pattern on the ejection target medium in the ink image forming step, detecting an image quality of the test pattern after the aqueous liquid component is removed from the test pattern in the liquid absorbing step, and evaluating a state of the porous body from the detected image quality.

7. The inkjet recording method according to claim 6, wherein the evaluated state of gas permeability is corrected based on the evaluated state of the porous body.

8. The inkjet recording method according to claim 1, wherein the porous body is replaceable and the specific parameter is attached to each individual porous body, while the specific parameter stored in the information storage medium is updated when the porous body is exchanged.

9. The inkjet recording method according to claim 1, wherein the ejection target medium is a transfer body that temporarily holds the ink image, the ink image being transferred to a recording medium to form a final image from the transfer body.

10. The inkjet recording method according to claim 1, wherein the ejection target medium is a recording medium to form a final image.

11. The inkjet recording method according to claim 1, wherein the porous body has a configuration of an endless web shape.

12. An inkjet recording apparatus comprising:

an ink image forming unit configured to apply an ink and a reaction liquid for increasing a viscosity of the ink to an ejection target medium to form an ink image on the ejection target medium, the ink containing an aqueous liquid component and a coloring material and being discharged by an inkjet method, the ink image containing the aqueous liquid component and the coloring material;

a liquid absorber unit having a liquid absorbing member in a liquid absorption treatment region, the liquid absorbing member including a porous body for absorbing at least a part of the aqueous liquid component from the ink image via a liquid absorbing surface thereof to be brought into contact with the ink image;

a transport mechanism configured to carry out the porous body from the liquid absorption treatment region and carry back the porous body to the liquid absorption treatment region; and an apparatus operation control section configured to control operation of the ink image forming unit, the liquid absorber unit and the transport mechanism, the apparatus further comprising:

a contact information storing section that stores contact information, the contact information including the number of contact times to an ink image of the liquid absorbing surface of the porous body and a contact pressure applied to the liquid absorbing surface of the porous body in each contact, the porous body being carried back to the liquid absorption treatment region by the transport mechanism; and a gas permeability state evaluating section configured to evaluate a state of gas permeability of the porous body based on the contact information and a specific parameter regarding a gas permeability of the porous body.

13. The inkjet recording apparatus according to claim 12, further comprising a porous body processing control section configured to select and instruct a processing regarding the porous body according to the state of gas permeability of the porous body evaluated by the gas permeability state evaluating section.

14. The inkjet recording apparatus according to claim 13, wherein the processing regarding the porous body is to notify an exchange timing of the porous body.

15. The inkjet recording apparatus according to claim 13, wherein the processing regarding the porous body is to stop an operation of image formation.

16. The inkjet recording apparatus according to claim 12, wherein the specific parameter is a coefficient of each term of a polynomial when fitting to the polynomial of the number of contact times x and the contact pressure y as variables relative to a gas permeability z which is evaluated through repeated application of a contact pressure to the porous body in advance.

17. The inkjet recording apparatus according to claim 12, further comprising:

an image quality detecting unit configured to detect an image quality of the ink image after the aqueous liquid component is absorbed from the ink image in the liquid absorption treatment region of the liquid absorber unit; and a porous body state evaluating section configured to instruct the apparatus operation control section to form a test pattern for image quality check by the ink image forming unit and detect an image quality of the test pattern after the aqueous liquid component is absorbed from the test pattern in the liquid absorption treatment region of the liquid absorber unit by the image quality detecting unit, the porous body state evaluating section being further configured to evaluate a state of the porous body from the detected image quality.

18. The inkjet recording apparatus according to claim 17, wherein the gas permeability state evaluating section has a correction function, the correction function being configured to correct the evaluated state of gas permeability of the porous body based on the evaluated state of the porous body.

19. The inkjet recording apparatus according to claim 12, wherein:

the porous body is replaceable and the specific parameter is attached to each individual porous body, while an input section is provided for updating the specific parameter stored in the contact information storing section when the porous body is exchanged.

20. The inkjet recording apparatus according to claim 12, wherein:

the ejection target medium is a transfer body that temporarily holds the ink image, and a transfer unit is provided, the transfer unit being configured to transfer the ink image to a recording medium to form a final image after liquid absorbing treatment by the liquid absorber unit.

21. The inkjet recording apparatus according to claim 12, wherein the ejection target medium is a recording medium to form a final image.

22. The inkjet recording apparatus according to claim 12, wherein the porous body has a configuration of an endless web shape.

23. An inkjet recording apparatus comprising:

a transfer body;

an ink image forming unit configured to apply an ink and a reaction liquid for increasing a viscosity of the ink to the transfer body to form an ink image on the transfer body, the ink containing an aqueous liquid component and a coloring material and being discharged by an inkjet method, the ink image containing the aqueous liquid component and the coloring material;

a liquid absorber unit having a liquid absorbing member in a liquid absorption treatment region, the liquid absorbing member including a porous body for absorbing at least a part of the aqueous liquid component from the ink image via a liquid absorbing surface thereof to be brought into contact with the ink image to condense the ink forming the ink image;

a transport mechanism configured to carry out the porous body from the liquid absorption treatment region and carry back the porous body to the liquid absorption treatment region;

an apparatus operation control section configured to control operation of the ink image forming unit, the liquid absorber unit and the transport mechanism; and a transfer section configured to transfer the ink image from the transfer body to a recording medium after a liquid absorbing treatment for the aqueous liquid component is performed by the liquid absorber unit, the apparatus further comprising:

a contact information storing section that stores contact information, the contact information including the number of contact times to an ink image of the liquid absorbing surface of the porous body and a contact pressure applied to the liquid absorbing surface of the porous body in each contact, the porous body being carried back to the liquid absorption treatment region by the transport mechanism; and a gas permeability state evaluating section configured to evaluate a state of gas permeability of the porous body based on the contact information and a specific parameter regarding a gas permeability of the porous body.

* * * * *